US006322692B1

(12) United States Patent
Cody et al.

(10) Patent No.: US 6,322,692 B1
(45) **Date of Patent: *Nov. 27, 2001**

(54) HYDROCONVERSION PROCESS FOR MAKING LUBRICATING OIL BASESTOCKS

(75) Inventors: Ian A. Cody; Douglas R. Boate, both of Baton Rouge, LA (US); Sandra J. Linek, Williamstown, NJ (US); William J. Murphy, Baton Rouge, LA (US); John E. Gallagher, Califon, NJ (US); Alberto Ravella, Baton Rouge, LA (US); Richard A. Demmin, Highland Park, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/532,377

(22) Filed: Mar. 21, 2000

Related U.S. Application Data

(60) Continuation-in-part of application No. 09/318,075, filed on May 25, 1999, now abandoned, which is a division of application No. 08/768,252, filed on Dec. 17, 1996, now Pat. No. 6,096,189.

(51) Int. Cl.[7] ..... E10G 7/04

(52) U.S. Cl. ..... 208/18; 208/87; 208/97; 208/58; 208/72; 208/71; 208/88; 208/95; 208/57

(58) Field of Search ..... 208/18, 27, 26, 208/31, 58, 97, 96

(56) References Cited

U.S. PATENT DOCUMENTS

| | | | | |
|---|---|---|---|---|
| 4,764,265 | | 8/1988 | Bijwaard et al. | 108/18 |
| 5,911,874 | * | 8/1999 | Cody et al. | 208/87 |
| 5,935,417 | * | 8/1999 | Cody et al. | 208/87 |

* cited by examiner

*Primary Examiner*—Helane E. Myers
(74) *Attorney, Agent, or Firm*—James H. Takemoto

(57) ABSTRACT

A process for producing a lubricating oil basestock having at least 90 wt. % saturates and a VI of at least 105 by selectively hydroconverting a raffinate from a solvent extraction zone in a two step hydroconversion zone followed by a hydrofinishing zone, and a lubricating oil basestock produced by said process.

11 Claims, 13 Drawing Sheets

Reactor C Conditions: (a) 330C, 2.5 LHSV, 1800# H2; (b) 350C, 2.5 LHSV, 1800# H2 (c) 350, 1 LHSV, 1800# H2

HYDROCONVERSION PROCESS FOR MAKING LUBRICATING OIL BASESTOCKS

CROSS REFERENCE TO RELATED APPLICATION

This is a continuation-in-part of U.S. Ser. No. 09/318,075 filed May 25, 1999 now abandoned, which is a divisional of U.S. patent application Ser. No. 08/768,252, filed Dec. 17, 1996 now U.S. Pat. No. 6,096,189.

FIELD OF THE INVENTION

This invention relates to lubricating oil basestocks and to a process for preparing lubricating oil basestocks having a high saturates content, high viscosity indices and low volatilities.

BACKGROUND OF THE INVENTION

It is well known to produce lubricating oil basestocks by solvent refining. In the conventional process, crude oils are fractionated under atmospheric pressure to produce atmospheric resids which are further fractionated under vacuum. Select distillate fractions are then optionally deasphalted and solvent extracted to produce a paraffin rich raffinate and an aromatics rich extract. The raffinate is then dewaxed to produce a dewaxed oil which is usually hydrofinished to improve stability and remove color bodies.

Solvent refining is a process which selectively isolates components of crude oils having desirable properties for lubricant basestocks. Thus the crude oils used for solvent refining are restricted to those which are highly paraffinic in nature as aromatics tend to have lower viscosity indices (VI), and are therefore less desirable in lubricating oil basestocks. Also, certain types of aromatic compounds can result in unfavorable toxicity characteristics. Solvent refining can produce lubricating oil basestocks have a VI of about 95 in good yields.

Today more severe operating conditions for automobile engines have resulted in demands for basestocks with lower volatilities (while retaining low viscosities) and lower pour points. These improvements can only be achieved with basestocks of more isoparaffinic character, i.e., those with VI's of 105 or greater. Solvent refining alone cannot economically produce basestocks having a VI of 105 with typical crudes. Nor does solvent refining alone typically produce basestocks with high saturates contents. Two alternative approaches have been developed to produce high quality lubricating oil basestocks; (1) wax isomerization and (2) hydrocracking. Both of the methods involve high capital investments. In some locations wax isomerization economics can be adversely impacted when the raw stock, slack wax, is highly valued. Also, the typically low quality feedstocks used in hydrocracking, and the consequent severe conditions required to achieve the desired viscometric and volatility properties can result in the formation of undesirable (toxic) species. These species are formed in sufficient concentration that a further processing step such as extraction is needed to achieve a non-toxic base stock.

An article by S. Bull and A. Marmin entitled "Lube Oil Manufacture by Severe Hydrotreatment," Proceedings of the Tenth World Petroleum Congress, Volume 4, Developments in Lubrication, PD 19(2), pages 221–228, describes a process wherein the extraction unit in solvent refining is replaced by a hydrotreater.

U.S. Pat. No. 3,691,067 describes a process for producing a medium and high VI oil by hydrotreating a narrow cut lube feedstock. The hydrotreating step involves a single hydrotreating zone. U.S. Pat. No. 3,732,154 discloses hydrofinishing the extract or raffinate from a solvent extraction process. The feed to the hydrofinishing step is derived from a highly aromatic source such as a naphthenic distillate. U.S. Pat. No. 4,627,908 relates to a process for improving the bulk oxidation stability and storage stability of lube oil basestocks derived from hydrocracked bright stock. The process involves hydrodenitrification of a hydrocracked bright stock followed by hydrofinishing.

It would be desirable to supplement the conventional solvent refining process so as to produce high VI, low volatility oils which have excellent toxicity, oxidative and thermal stability, fuel economy and cold start properties without incurring any significant yield debit which process requires much lower investment costs than competing technologies such as hydrocracking.

SUMMARY OF THE INVENTION

This invention relates to a lubricating oil basestock produced by a process which comprises:

(a) conducting a lubricating oil feedstock, said feedstock being a distillate fraction, to a solvent extraction zone and under-extracting the feedstock to form an under-extracted raffinate;

(b) stripping the under-extracted raffinate of solvent to produce an under-extracted raffinate feed having a dewaxed oil viscosity index from about 75 to about 105;

(c) passing at least a portion of the raffinate feed to a first hydroconversion zone and processing the raffinate feed in the presence of a non-acidic catalyst at a temperature of from 320 to 420° C., a hydrogen partial pressure of from 1000 to 2500 psig (7.0 to 17.3 mPa), space velocity of 0.2 to 5.0 LHSV and a hydrogen to feed ratio of from 500 to 5000 Scf/B (89 to 890 $m^3/m^3$) to produce a first hydroconverted raffinate;

(d) passing the hydroconverted raffinate from the first hydroconversion zone to a second hydroconversion zone and processing the hydroconverted raffinate in the presence of a non-acidic catalyst at a temperature of from 320 to 420° C. provided that the temperature in the second hydroconversion is not greater than the temperature in the first hydroconversion zone, a hydrogen partial pressure of from 1000 to 2500 psig (7.0 to 17.3 mPa), a space velocity of from 0.2 to 5.0 LHSV and a hydrogen to feed ratio of from 500 to 5000 Scf/B (89 to 890 $m^3/m^3$) to produce a second hydroconverted raffinate;

(e) passing at least a portion of the second hydroconverted raffinate to a hydrofinishing reaction zone and conducting cold hydrofinishing of the second hydroconverted raffinate in the presence of a hydrofinishing catalyst which is at least one Group VIB or Group VIII metal on a refractory metal oxide support at a temperature of from 200 to 360° C., a hydrogen partial pressure of from 1000 to 2500 psig (7.0 to 17.3 mPa), a space velocity of from 0.2 to 10 LHSV and hydrogen to feed ratio of from 500 to 5000 Scf/B (89 to 890 $m^3/m^3$) to produce a hydrofinished raffinate.

The basestocks produced by the process according to the invention have excellent low volatility properties for a given viscosity thereby meeting future industry engine oil standards while achieving good oxidation stability, cold start, fuel economy, and thermal stability properties. In addition, toxicity tests show that the basestock has excellent toxicological properties as measured by tests such as the FDA(c) test.

DETAILED DESCRIPTION OF THE INVENTION

Figure 1:
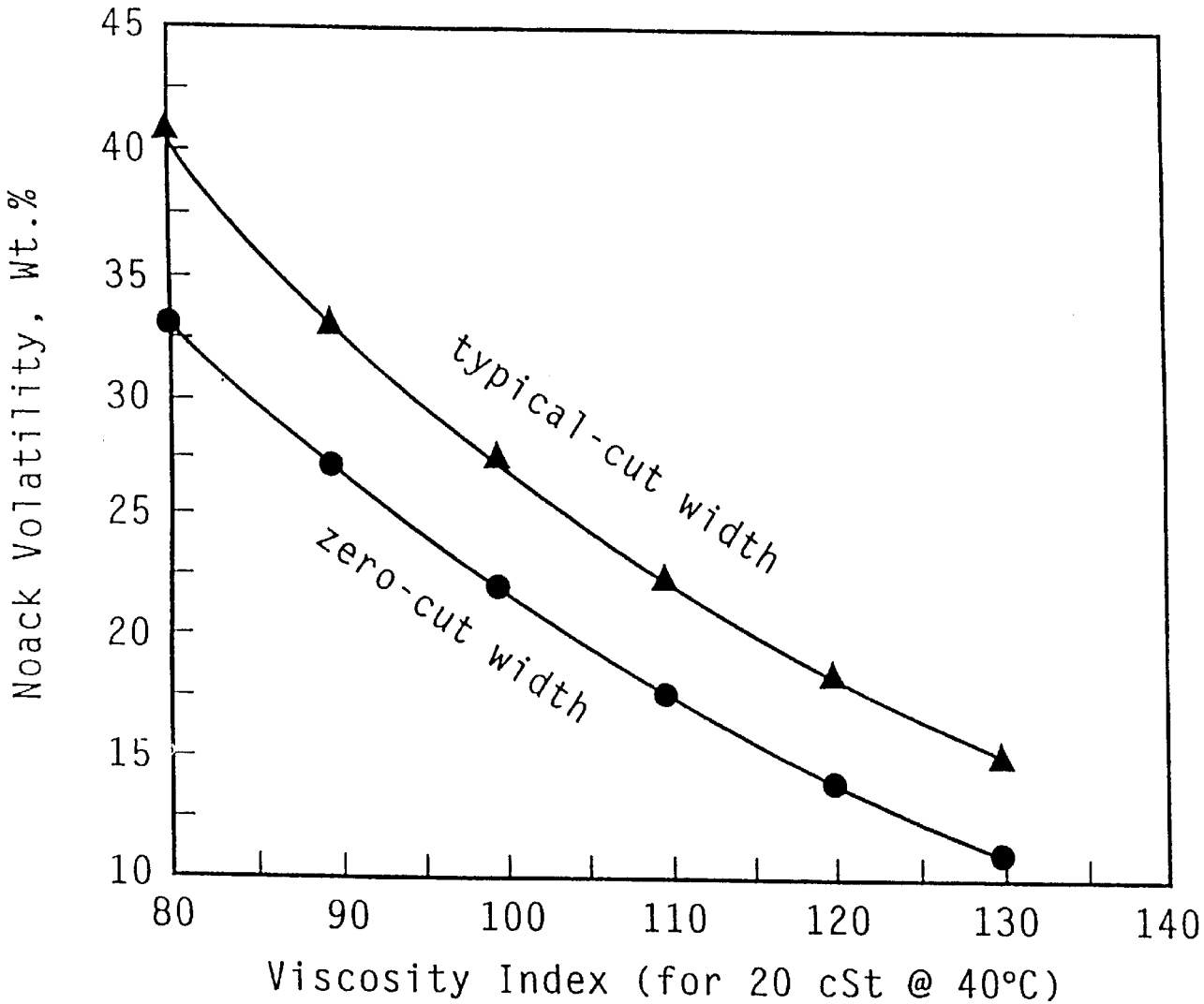
FIG. 1 is a plot of NOACK volatility vs. viscosity index for a 100N basestock.

The solvent refining of select crude oils to produce lubricating oil basestocks typically involves atmospheric distillation, vacuum distillation, extraction, dewaxing and hydrofinishing. Because basestocks having a high isoparaffin content are characterized by having good viscosity index (VI) properties and suitable low temperature properties, the crude oils used in the solvent refining process are typically paraffinic crudes. One method of classifying lubricating oil basestocks is that used by the American Petroleum Institute (API). API Group II basestocks have a saturates content of 90 wt. % or greater, a sulfur content of not more than 0.03 wt. % and a viscosity index (VI) greater than 80 but less than 120. API Group III basestocks are the same as Group II basestocks except that the VI is greater than or equal to 120.

Generally, the high boiling petroleum fractions from atmospheric distillation are sent to a vacuum distillation unit, and the distillation fractions from this unit are solvent extracted. The residue from vacuum distillation which may be deasphalted is sent to other processing.

The solvent extraction process selectively dissolves the aromatic components in an extract phase while leaving the more paraffinic components in a raffinate phase. Naphthenes are distributed between the extract and raffinate phases. Typical solvents for solvent extraction include phenol, furfural and N-methyl pyrrolidone. By controlling the solvent to oil ratio, extraction temperature and method of contacting distillate to be extracted with solvent, one can control the degree of separation between the extract and raffinate phases.

In recent years, solvent extraction has been replaced by hydrocracking as a means for producing high VI basestocks in some refineries. The hydrocracking process utilizes low quality feeds such as feed distillate from the vacuum distillation unit or other refinery streams such as vacuum gas oils and coker gas oils. The catalysts used in hydrocracking are typically sulfides of Ni, Mo, Co and W on an acidic support such as silica/alumina or alumina containing an acidic promoter such as fluorine. Some hydrocracking catalysts also contain highly acidic zeolites. The hydrocracking process may involve hetero-atom removal, aromatic ring saturation, dealkylation of aromatics rings, ring opening, straight chain and side-chain cracking, and wax isomerization depending on operating conditions. In view of these reactions, separation of the aromatics rich phase that occurs in solvent extraction is an unnecessary step since hydrocracking can reduce aromatics content to very low levels.

By way of contrast, the process of the present invention utilizes a three step hydroconversion of the raffinate from the solvent extraction unit under conditions which minimizes hydrocracking and passing waxy components through the process without wax isomerization. Thus, dewaxed oil (DWO) and low value foots oil streams can be added to the raffinate feed whereby the wax molecules pass unconverted through the process and may be recovered as a valuable by-product.

The distillate feeds to the extraction zone are from a vacuum or atmospheric distillation unit, preferably from a vacuum distillation unit and may be of poor quality. The feeds may contain nitrogen and sulfur contaminants in excess of 1 wt. % based on feed.

Moreover, unlike hydrocracking, the present process may take place without disengagement, i.e., without any intervening steps involving gas/liquid products separations. The product of the subject three step process has a saturates content greater than 90 wt. %, preferably greater than 95 wt. %. Thus product quality is similar to that obtained from hydrocracking without the high temperatures and pressures required by hydrocracking which results in a much greater investment expense.

The raffinate from the solvent extraction is preferably under-extracted, i.e., the extraction is carried out under conditions such that the raffinate yield is maximized while still removing most of the lowest quality molecules from the feed. Raffinate yield may be maximized by controlling extraction conditions, for example, by lowering the solvent to oil treat ratio and/or decreasing the extraction temperature. The raffinate from the solvent extraction unit is stripped of solvent and then sent to a first hydroconversion unit (zone) containing a hydroconversion catalyst. This raffinate feed to the first hydroconversion unit is extracted to a dewaxed oil viscosity index of from about 75 to about 105, preferably 80 to 95.

In carrying out the extraction process, water may be added to the extraction solvent in amounts ranging from 1 to 10 vol. % such that the extraction solvent to the extraction tower contains from 3–10 vol. % water, preferably from 4–7 vol. % water. In general, feed to the extraction tower is added at the bottom of the tower and extraction/water solvent mixture added at the top, and the feed and extraction solvent contacted in counter-current flow. The extraction solvent containing added water may be injected at different levels if the extraction tower contains multiple trays for solvent extraction. The use of added water in the extraction solvent permits the use of low quality feeds while maximizing the paraffin content of the raffinate and the 3+ multi-ring compounds content of the extract. Solvent extraction conditions include a solvent to oil ratio of from 0.5 to 5.0, preferably 1 to 3 and extraction temperatures of from 40 to 120° C., preferably 50 to 100° C.

If desired, the raffinate feed may be solvent dewaxed under solvent dewaxing conditions prior to entering the first hydroconversion zone. It may be advantageous to remove wax from the feed since very little, if any wax is converted in the hydroconversion units. This may assist in debottlenecking the hydroconversion units if throughput is a problem.

Hydroconversion catalysts are those containing Group VIB metals (based on the Periodic Table published by Fisher Scientific), and non-noble Group VIII metals, i.e., iron, cobalt and nickel and mixtures thereof These metals or mixtures of metals are typically present as oxides or sulfides on refractory metal oxide supports. Examples of Group VIB metals include molybdenum and tungsten.

It is important that the metal oxide support be non-acidic so as to control cracking. A useful scale of acidity for catalysts is based on the isomerization of 2-methyl-2-pentene as described by Kramer and McVicker, J. Catalysis, 92, 355 (1985). In this scale of acidity, 2-methyl-2-pentene is subjected to the catalyst to be evaluated at a fixed temperature, typically 200° C. In the presence of catalyst sites, 2-methyl-2-pentene forms a carbenium ion. The isomerization pathway of the carbenium ion is indicative of the acidity of active sites in the catalyst. Thus weakly acidic sites form 4methyl-2-pentene whereas strongly acidic sites result in a skeletal rearrangement to 3-methyl-2-pentene with very strongly acid sites forming 2,3-dimethyl-2-butene. The mole ratio of -methyl-2-pentene to 4-methyl-2-pentene can be correlated to a scale of acidity. This acidity scale ranges from 0.0 to 4.0. Very weakly acidic sites will have values near 0.0 whereas very strongly acidic sites will have values approaching 4.0. The catalysts useful in the present process have acidity values of less than about 0.5, preferably less than about 0.3. The acidity of metal oxide supports can be controlled by adding promoters and/or dopants, or by controlling the nature of the metal oxide support, e.g., by controlling the amount of silica incorporated into a silica-alumina support. Examples of promoters and/or dopants include halogen, especially fluorine, phosphorus, boron, yttria, rare-earth oxides and magnesia. Promoters such as halogens generally increase the acidity of metal oxide supports while mildly basic dopants such as yttria or magnesia tend to decrease the acidity of such supports.

Suitable metal oxide supports include low acidic oxides such as silica, alumina or titania, preferably alumina. Preferred aluminas are porous aluminas such as gamma or eta having average pore sizes from 50 to 200 Å, preferably 75 to 150 Å, a surface area from 100 to 300 $m^2/g$, preferably 150 to 250 $m^2/g$ and a pore volume of from 0.25 to 1.0 $cm^3/g$, preferably 0.35 to 0.8 $cm^3/g$. The supports are preferably not promoted with a halogen such as fluorine as this generally increases the acidity of the support above 0.5.

Preferred metal catalysts include cobalt/molybdenum (1–5% Co as oxide, 10–25% Mo as oxide) nickel/molybdenum (1–5% Ni as oxide, 10–25% Co as oxide) or nickel/tungsten (1–5% Ni as oxide, 10–30% W as oxide) on alumina. Especially preferred are nickel/molybdenum catalysts such as KF-840.

Hydroconversion conditions in the first hydroconversion unit include a temperature of from 320 to 420° C., preferably 340 to 400° C., a hydrogen partial pressure of from 1000 to 2500 psig (7.0 to 17.3 mPa), preferably 1000 to 2000 psig (7.0 to 13.9 mPa), a space velocity of from 0.2 to 5.0 LHSV, preferably 0.3 to 3.0 LHSV, and a hydrogen to feed ratio of from 500 to 5000 Scf/B (89 to 890 $m^3/m^3$), preferably 2000 to 4000 Scf/B (356 to 712 $m^3/m^3$).

The hydroconverted raffinate from the first hydroconversion unit is conducted to a second hydroconversion unit. The hydroconverted raffinate is preferably passed through a heat exchanger located between the first and second hydroconversion units so that the second hydroconversion unit can be run at cooler temperatures, if desired. Temperatures in the second hydroconversion unit should not exceed the temperature used in the first hydroconversion unit. It is preferred that the temperature in the second hydroconversion unit be 5 to 100° C. lower than the temperature in the first hydroconversion unit. Conditions in the second hydroconversion unit include a temperature of from 320 to 420° C., preferably 320 to 400° C., a hydrogen partial pressure of from 1000 to 2500 psig (7.0 to 17.3 Mpa), preferably 1000 to 2000 psig (7.0 to 13.9 Mpa), a space velocity of from 0.2 to 5.0 LHSV, preferably 0.3 to 1.5 LHSV, and a hydrogen to feed ratio of from 500 to 5000 Scf/B (89 to 890 $m^3/m^3$), preferably 2000 to 4000 Scf/B (356 to 712 $m^3/m^3$). The catalyst in the second hydroconversion unit can be the same as in the first hydroconversion unit, although a different hydroconversion catalyst may be used.

The hydroconverted raffinate from the second hydroconversion unit is then conducted to cold hydrofinishing unit. A heat exchanger is preferably located between these units. Reaction conditions in the hydrofinishing unit are mild and include a temperature of from 200 to 360° C., preferably 290 to 350° C., a hydrogen partial pressure of from 1000 to 2500 psig (7.0 to 17.3 mPa), preferably 1000 to 2000 psig (7.0 to 13.9 mPa), a space velocity of from 0.2 to 10.0 LHSV, preferably 0.7 to 3.0 LHSV, and a hydrogen to feed ratio of from 500 to 5000 SCF/B (89 to 890 $m^3/m^3$), preferably 2000 to 4000 Scf/B (356 to 712 $m^3/m^3$). The catalyst in the cold hydrofinishing unit may be the same as in the first hydroconversion unit. However, more acidic catalyst supports such as silica-alumina, zirconia and the like may be used in the cold hydrofinishing unit. Catalysts may also include Group VIII noble metals, preferably Pt, Pd or mixtures thereof on a metal oxide support which may be promoted. The catalyst and hydroconverted raffinate may be contacted in counter-current flow.

In order to prepare a finished basestock, the hydroconverted raffinate from the hydrofinishing unit may be conducted to a separator e.g., a vacuum stripper (or fractionation) to separate out low boiling products. Such products may include hydrogen sulfide and ammonia formed in the first two reactors. If desired, a stripper may be situated between the second hydroconversion unit and the hydrofinishing unit, but this is not essential to produce basestocks according to the invention. If a stripper is situated between the second hydroconversion unit and the hydrofinishing unit, then the stripper may be followed by at least one of catalytic dewaxing and solvent dewaxing.

The hydroconverted raffinate separated from the separator is then conducted to a dewaxing unit. Dewaxing may be accomplished by catalytic processes under catalytic dewaxing conditions, by solvent dewaxing under solvent dewaxing conditions using a solvent to dilute the hydrofinished raffinate and chilling to crystallize and separate wax molecules, or by a combination of solvent dewaxing and catalytic dewaxing. Typical solvents include propane and ketones. Preferred ketones include methyl ethyl ketone, methyl isobutyl ketone and mixtures thereof. Dewaxing catalysts are molecular sieves, preferably 10 ring molecular sieves, especially unidimensioinal 10 ring molecular sieves.

If a dewaxing catalyst is employed which is tolerant of low boiling products containing nitrogen or sulfur, it may be possible to by-pass the separator and conduct the hydroconverted raffinate directly to a catalytic dewaxing unit and subsequently to a hydrofinishing zone.

In another embodiment, the dewaxing catalyst may be included within the second hydroconversion zone following the hydroconversion catalyst. In this stacked bed configuration, the hydroconverted raffinate from the first hydroconversion zone would first contact the hydroconversion catalyst in the second hydroconversion zone and the hydroconverted raffinate contacted with the dewaxing catalyst situated within the second hydroconversion zone and after the second hydroconversion catalyst.

The solvent/hydroconverted raffinate mixture may be cooled in a refrigeration system containing a scraped-surface chiller. Wax separated in the chiller is sent to a separating unit such as a rotary filter to separate wax from oil. The dewaxed oil is suitable as a lubricating oil basestock. If desired, the dewaxed oil may be subjected to catalytic isomerization/dewaxing to further lower the pour point. Separated wax may be used as such for wax coatings, candles and the like or may be sent to an isomerization unit.

The lubricating oil basestock produced by the process according to the invention is characterized by the following properties: viscosity index of at least about 105, preferably at least 107 and saturates of at least 90%, preferably at least 95 wt. %, NOACK volatility improvement (as measured by DIN 51581) over raffinate feedstock of at least about 3 wt. %, preferably at least about 5 wt. %, at the same viscosity within the range 3.5 to 6.5 cSt viscosity at 100° C., pour point of −15° C. or lower, and a low toxicity as determined by IP346 or phase 1 of FDA (c). IP346 is a measure of polycyclic aromatic compounds. Many of these compounds are carcinogens or suspected carcinogens, especially those with so-called bay regions [see Accounts Chem. Res. 17, 332(1984) for further details]. The present process reduces these polycyclic aromatic compounds to such levels as to pass carcinogenicity tests. The FDA (c) test is set forth in 21 CFR 178.3620 and is based on ultraviolet absorbances in the 300 to 359 nm range.

As can be seen from FIG. 1, NOACK volatility is related to VI for any given basestock. The relationship shown in FIG. 1 is for a light basestock (about 100N). If the goal is to meet a 22 wt. % NOACK volatility for a 100N oil, then the oil should have a VI of about 110 for a product with typical-cut width, e.g., 5 to 50% off by GCD at 60° C. Volatility improvements can be achieved with lower VI product by decreasing the cut width. In the limit set by zero cut width, one can meet 22% NOACK volatility at a VI of about 100. However, this approach, using distillation alone, incurs significant yield debits.

Hydrocracking is also capable of producing high VI, and consequently low NOACK volatility basestocks, but is less selective (lower yields) than the process of the invention. Furthermore both hydrocracking and processes such as wax isomerization destroy most of the molecular species responsible for the solvency properties of solvent refined oils. The latter also uses wax as a feedstock whereas the present process is designed to preserve wax as a product and does little, if any, wax conversion.

Figure 2:
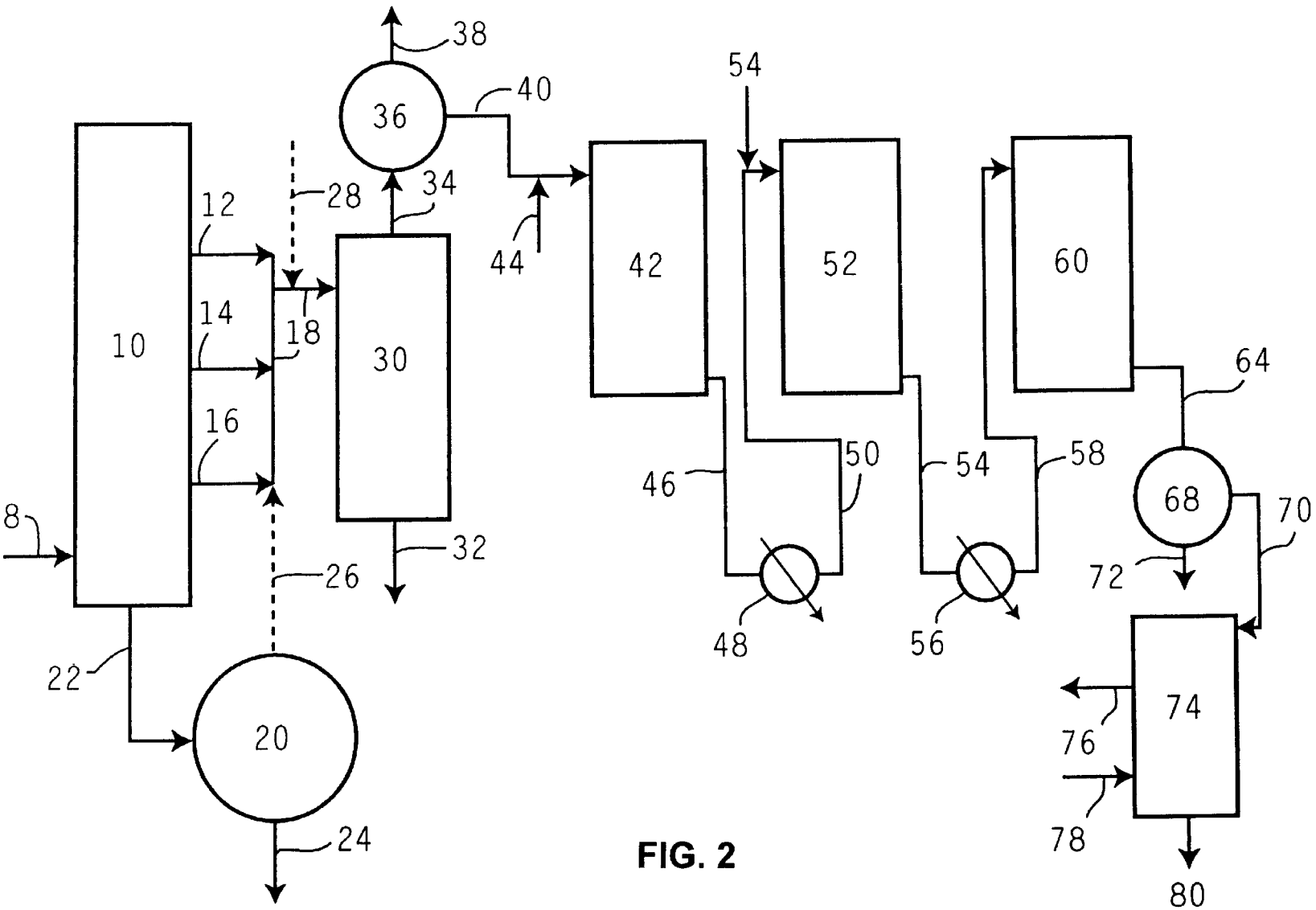
FIG. 2 is a schematic flow diagram of the hydroconversion process.

The process of the invention is further illustrated by FIG. 2. The feed 8 to vacuum pipestill 10 is typically an atmospheric reduced crude from an atmospheric pipestill (not shown). Various distillate cuts shown as 12 (light), 14 (medium) and 16 (heavy) may be sent to solvent extraction unit 30 via line 18. These distillate cuts may range from about 200° C. to about 650° C. The bottoms from vacuum pipestill 10 may be sent through line 22 to a coker, a visbreaker or a deasphalting extraction unit 20 where the bottoms are contacted with a deasphalting solvent such as propane, butane or pentane. The deasphalted oil may be combined with distillate from the vacuum pipestill 10 through line 26 provided that the deasphalted oil has a boiling point no greater than about 650° C. or is preferably sent on for further processing through line 24. The bottoms from deasphalter 20 can be sent to a visbreaker or used for asphalt production. Other refinery streams may also be added to the feed to the extraction unit through line 28 provided they meet the feedstock criteria described previously for raffinate feedstock.

In extraction unit 30, the distillate cuts are solvent extracted with n-methyl pyrrolidone and the extraction unit is preferably operated in countercurrent mode. The solvent-to-oil ratio, extraction temperature and percent water in the solvent are used to control the degree of extraction, i.e., separation into a paraffins rich raffinate and an aromatics rich extract. The present process permits the extraction unit to operate to an "under extraction" mode, i.e., a greater amount of aromatics in the paraffins rich raffinate phase. The aromatics rich extract phase is sent for further processing through line 32. The raffinate phase is conducted through line 34 to solvent stripping unit 36. Stripped solvent is sent through line 38 for recycling and stripped raffinate is conducted through line 40 to fist hydroconversion unit 42.

The first hydroconversion unit 42 contains KF-840 catalyst which is nickel/molybdenum on an alumina support and available from Akzo Nobel. Hydrogen is admitted to unit or reactor 42 through line 44. Gas chromatographic comparisons of the hydroconverted raffinate indicate that almost no wax isomerization is taking place. While not wishing to be bound to any particular theory since the precise mechanism for the VI increase which occurs in this stage is not known with certainty, it is known that heteroatoms are being removed, aromatic rings are being saturated and naphthene rings, particularly multi-ring naphthenes, are selectively eliminated.

Hydroconverted raffinate from hydroconversion unit 42 is conducted through line 46 to heat exchanger 48 where the hydroconverted raffinate stream may be cooled if desired. The cooled raffinate stream is conducted through line 50 to a second hydroconversion unit 52. Additional hydrogen, if needed, is added through line 54. This second hydroconversion unit is operated at a lower temperature (when required to adjust product quality) than the first hydroconversion unit 42. While not wishing to bound to any theory, it is believed that the capability to operate the second unit 52 at lower temperature shifts the equilibrium conversion between saturated species and other unsaturated hydrocarbon species back towards increased saturates concentration. In this way, the concentration of saturates can be maintained at greater than 90% wt. % by appropriately controlling the combination of temperature and space velocity in second hydroconversion unit 52.

Hydroconverted raffinate from unit 52 is conducted through line 54 to a second heater exchanger 56. After additional heat is removed through heat exchanger 56, cooled hydroconverted raffinate is conducted through line 58 to cold hydrofinishing unit 60. Temperatures in the hydrofinishing unit 60 are more mild than those of hydroconversion units 42 and 52. Temperature and space velocity in cold hydrofinishing unit 60 are controlled to reduce the toxicity to low levels, i.e., to a level sufficiently low to pass standard toxicity tests. This may be accomplished by reducing the concentration of polynuclear aromatics to very low levels.

Hydrofinished raffinate is then conducted through line 64 to separator 68. Light liquid products and gases are separated and removed through line 72. The remaining hydrofinished raffinate is conducted through line 70 to dewaxing unit 74. Dewaxing may occur by the use of solvents introduced through line 78 which may be followed by cooling, by catalytic dewaxing or by a combination thereof. Catalytic dewaxing involves hydrocracking or hydroisomerization as a means to create low pour point lubricant basestocks. Solvent dewaxing with optional cooling separates waxy molecules from the hydroconverted lubricant basestock thereby lowering the pour point. In markets where waxes are valued, hydrofinished raffinate is preferably contacted with methyl isobutyl ketone followed by the DILCHILL® Dewaxing Process developed by Exxon. This method is well known in the art. Finished lubricant basestock is removed through line 76 and waxy product through line 80.

While not wishing to be bound by any theory, the factors affecting saturates, VI and toxicity are discussed as follows. The term "saturates" refers to the sum of all saturated rings, paraffins and isoparaffins. In the present raffinate hydroconversion process, under-extracted (e.g., 92 VI) light and medium raffinates including isoparaffins, n-paraffins, naphthenes and aromatics having from 1 to about 6 rings are processed over a non-acidic catalyst which primarily operates to (a) hydrogenate aromatic rings to naphthenes and (b) convert ring compounds to leave isoparaffins in the lubes boiling range by either dealkylation or by ring opening of naphthenes. The catalyst is not an isomerization catalyst and therefore leaves paraffinic species in the feed largely unaffected. High melting paraffins and isoparaffins are removed by a subsequent dewaxing step. Thus other than residual wax the saturates content of a dewaxed oil product is a function of the irreversible conversion of rings to isoparaffins and the reversible formation of naphthenes from aromatic species.

Figure 3:
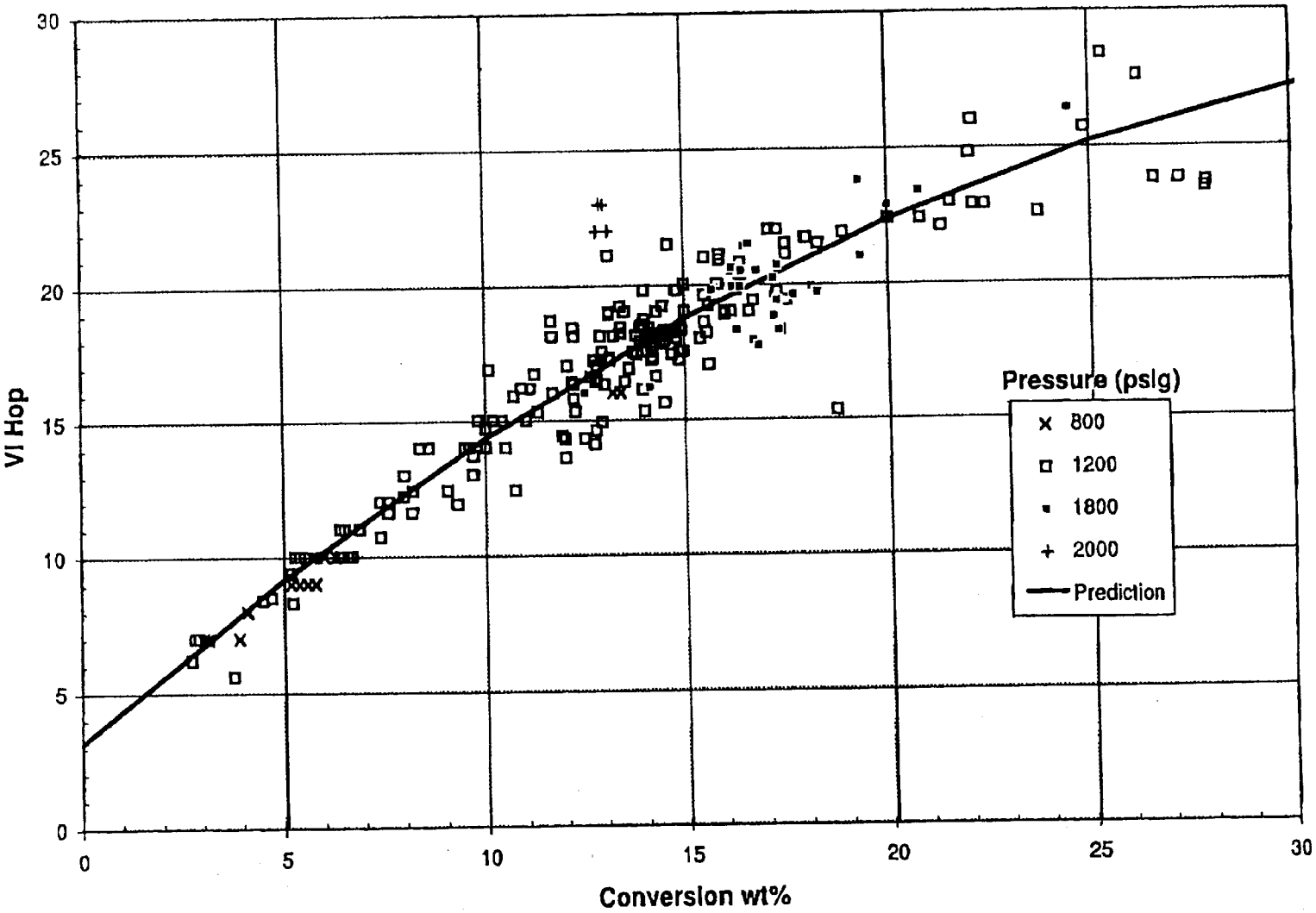
FIG. 3 is a graph showing VI HOP vs. conversion at different pressures.
Figure 4:
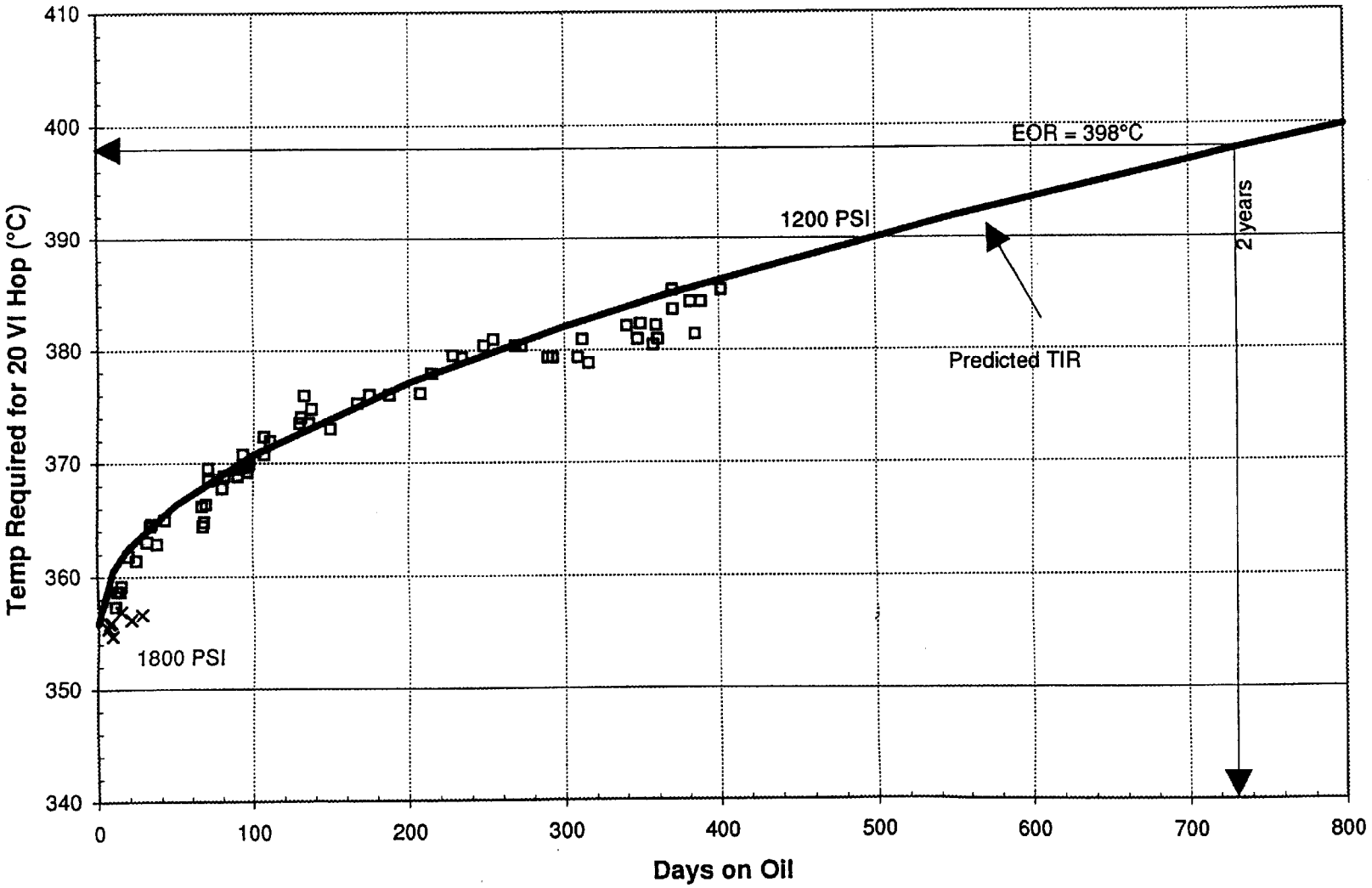
FIG. 4 is a graph showing temperature in the first hydroconversion zone as a function of days on oil at a fixed pressure.

To achieve a basestock viscosity index target, e.g,. 110 VI, for a fixed catalyst charge and feed rates, hydroconversion reactor temperature is the primary driver. Temperature sets the conversion (arbitrarily measured here as the conversion to 370° C.) which is nearly linearly related to the VI increase, irrespective of pressure. This is shown in FIG. 3 relating the VI increase (VI HOP) to conversion. For a fixed pressure, the saturates content of the product depends on the conversion, i.e., the VI achieved, and the temperature required to achieve conversion. At start of run on a typical feed, the temperature required to achieve the target VI may be only 350° C. and the corresponding saturates of the dewaxed oil will normally be in excess of 90 wt. %, for processes operating at or above 1000 psig (7.0 mPa) $H_2$. However, the catalyst deactivates with time such that the temperature required to achieve the same conversion (and the same VI) must be increased. Over a 2-year period, the temperature may increase by 25 to 50° C. depending on the catalyst, feed and the operating pressure. A typical deactivation profile is illustrated in FIG. 4 which shows temperature as a function of days on oil at a fixed pressure. In most circumstances, with process rates of about 1.0 v/v/hr or less and temperatures in excess of 350° C., the saturates associated with the ring species left in the product are determined only by the reactor temperature, i.e., the naphthene population reaches the equilibrium value for that temperature.

Figure 5:
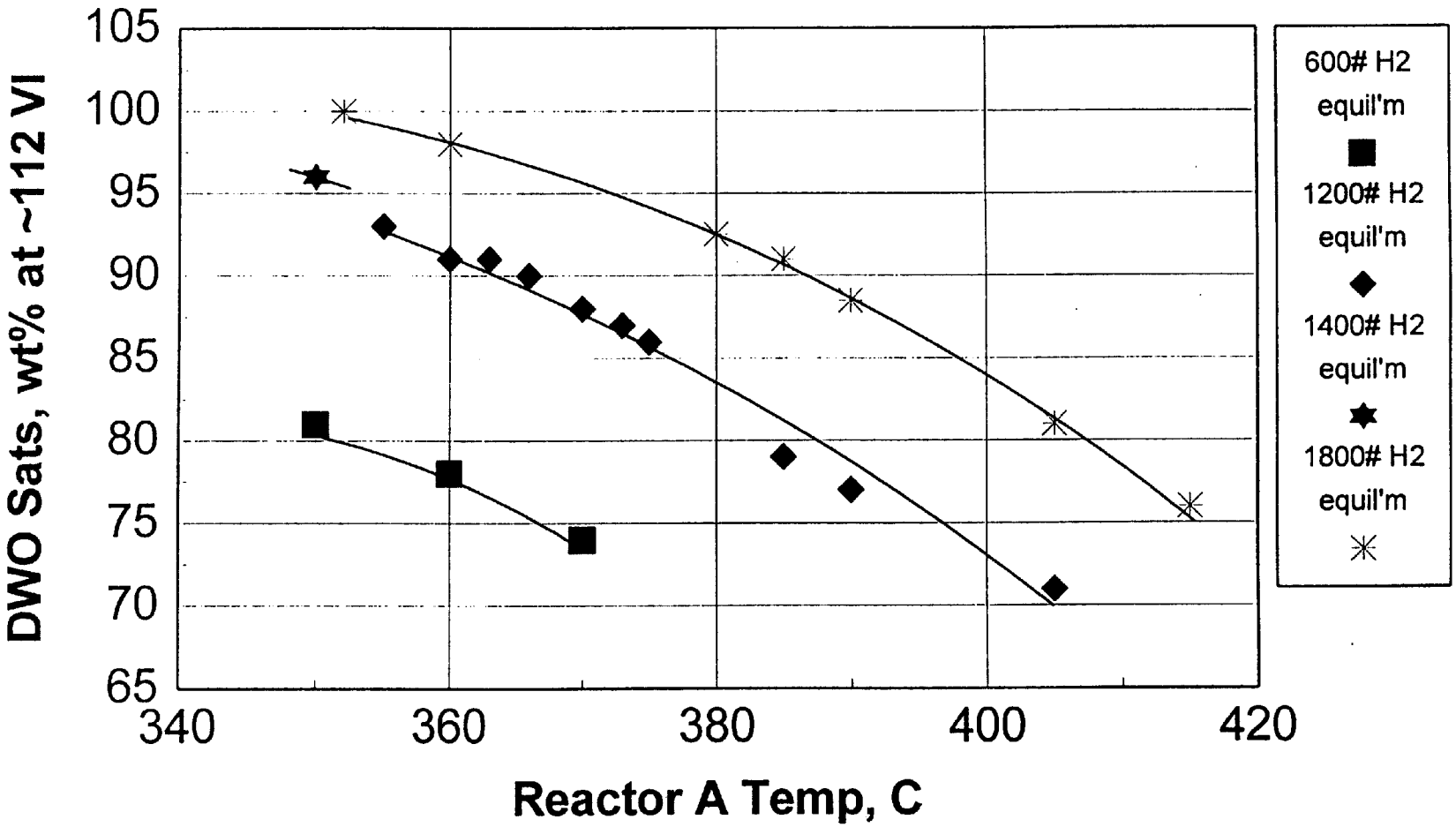
FIG. 5 is a graph showing saturates concentration as a function of reactor temperature for a fixed VI product.

Thus as the reactor temperature increases from about 350° C., saturates will decline along a smooth curve defining a product of fixed VI. FIG. 5 shows three typical curves for a fixed product of 112 VI derived from a 92 VI feed by operating at a fixed conversion. Saturates are higher for a higher pressure process in accord with simple equilibrium considerations. Each curve shows saturates falling steadily with temperatures increasing above 350° C. At 600 psig (4.24 mPa) $H_2$, the process is incapable of simultaneously meeting the VI target and the required saturates (90+wt. %). The projected temperature needed to achieve 90+wt. % saturates at 600 psig (4.24 mPa) is well below that which can be reasonably achieved with the preferred catalyst for this process at any reasonable feed rate/catalyst charge. However, at 1000 psig $H_2$ and above, the catalyst can simultaneously achieve 90 wt. % saturates and the target VI. It is well known that the equilibrium concentration of aromatics can be shifted in favor of paraffins by lowering the temperature. Thus by operating the reactor in the second reaction zone at a lower temperature than the reactor in the first hydroconversion zone, the equilibrium between saturates and aromatics can be shifted in favor of saturates.

An important aspect of the invention is that a temperature staging strategy can be further applied to maintain saturates at 90+ wt. % for process pressures of 1000 psig (7.0 mPa) $H_2$ or above without disengagement of sour gas and without the use of a polar sensitive hydrogenation catalyst such as massive nickel that is employed in typical hydrocracking schemes. The present process also avoids the higher temperatures and pressures of the conventional hydrocracking process. This is accomplished by separating the functions to achieve VI, saturates and toxicity using a cascading temperature profile over 3 reactors without the expensive insertion of stripping, recompression and hydrogenation steps. API Group II and III basestocks (API Publication 1509) can be produced in a single stage, temperature controlled process.

Figure 6:
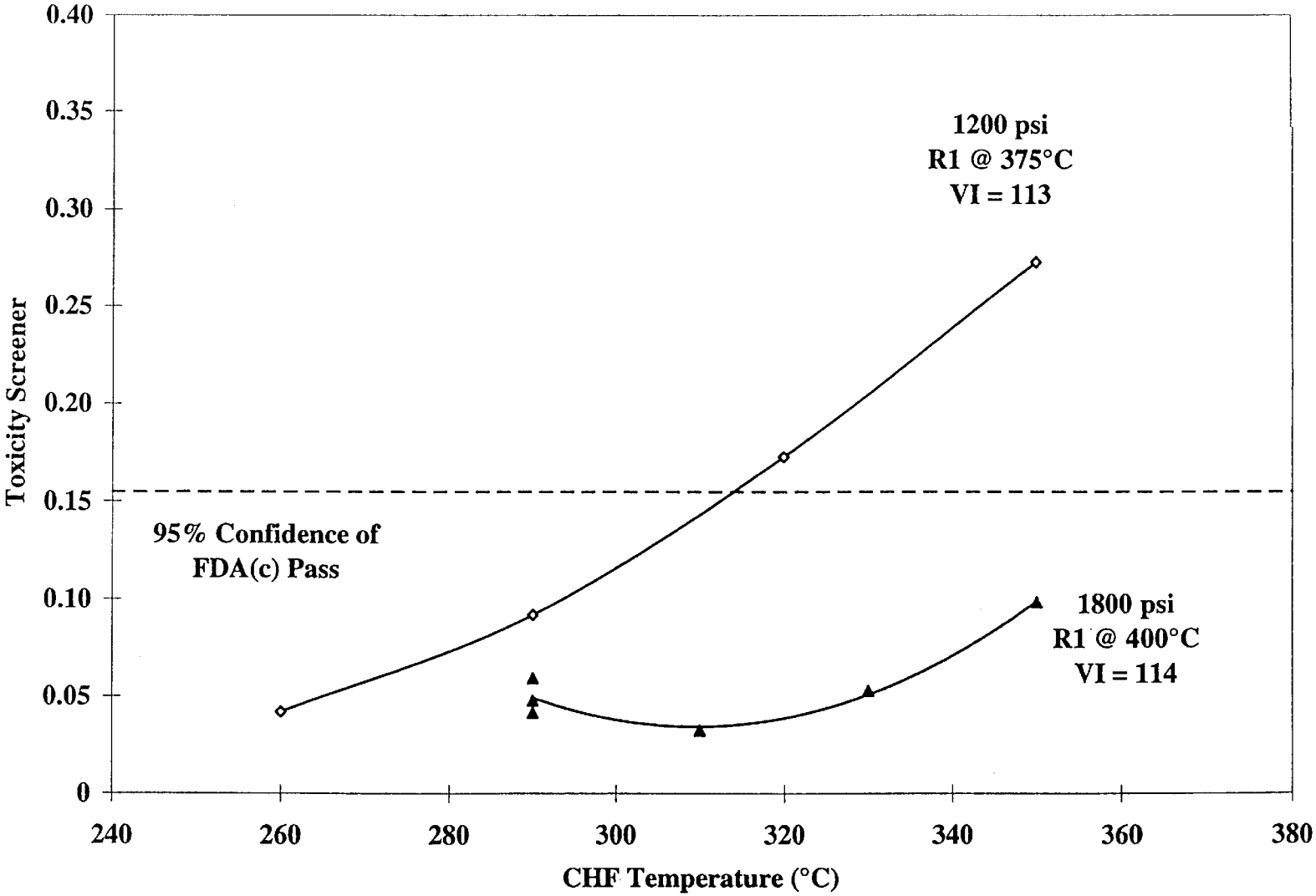
FIG. 6 is a graph showing toxicity as a function of temperature and pressure in the cold hydrofinishing step.

Toxicity of the basestock is adjusted in the cold hydrofinishing step. For a given target VI, the toxicity may be adjusted by controlling the temperature and pressure. This is illustrated in FIG. 6 which shows that higher pressures allows a greater temperature range to correct toxicity.

The basestocks produced according to the invention have unique properties. The basestocks have excellent volatility/viscosity properties typically observed for basestocks having much higher VI. These and other properties are the result of having multi-ring aromatics selectively removed. The presence of even small amounts of these aromatics can adversely impact properties of basestocks including viscosity, VI, toxicity and color.

The basestocks also have improved Noack volatility when compared to Group II hydrocrackates of the same viscosity. When formulated with conventional additive packages used with passenger car motor oils, the finished oils have excellent oxidation resistance, wear resistance, resistance to high temperature deposits and fuel economy properties as measured by engine test results. The basestocks according to the invention can have other uses such as automatic transmission fluids, agricultural oils, hydraulic fluids, electrical oils, industrial oils heavy duty engine oils and the like.

The invention is further illustrated by the following non-limiting examples.

EXAMPLE 1

This example illustrates the functions of each reactor A, B and C. Reactors A and B affect VI though A is controlling. Each reactor can contribute to saturates, but reactor B is primarily used to control saturates. Toxicity and color are controlled in reactor C.

TABLE 1

| PRIMARY CONTROL | Reactor A | Reactor B | Reactor C |
|---|---|---|---|
| VI | x | | |
| Saturates | | x | |
| Toxicity | | | x |

EXAMPLE 2

This example illustrates the product quality of oils obtained from the process according to the invention. Reaction conditions and product quality data for start of run (SOR) and end of run (EOR) are summarized in Tables 2 and 3.

As can be seen from the data in Table 2 for the 250N feed stock, reactors A and B operate at conditions sufficient to achieve the desired viscosity index, then, with adjustment of the temperature of reactor C., it is possible to keep saturates above 90 wt. % for the entire run length without compromising toxicity (as indicated by DMSO screener result; see Example 6). A combination of higher temperature and lower space velocity in reactor C (even at end of run conditions in reactors A and B) produced even higher saturates, 96.2%. For a 100N feed stock, end-of-run product with greater than 90% saturates may be obtained with reactor C operating as low as 290 C at 2.5 v/v/h (Table 3).

TABLE 2

| | SOR | | EOR | | EOR | | EOR | |
|---|---|---|---|---|---|---|---|---|
| Reactor | T (C) | LHSV (v/v/h) | T (C) | LHSV (v/v/h) | T (C) | LHSV (v/v/h) | T (C) | LHSV (v/v/h) |
| A | 352 | 0.7 | 400 | 0.7 | 400 | 0.7 | 400 | 0.7 |
| B | 352 | 1.2 | 400 | 1.2 | 400 | 1.2 | 400 | 1.2 |
| C | 290 | 2.5 | 290 | 2.5 | 350 | 2.5 | 350 | 1.0 |

| Dewaxed Oil Properties | 250N (1) Feed | SOR | EOR | EOR | EOR |
|---|---|---|---|---|---|
| 100C Viscosity, cSt | 7.34 | 5.81 | 5.53 | 5.47 | 5.62 |
| 40C Viscosity, cSt | 54.41 | 34.28 | 31.26 | 30.63 | 32.08 |
| Viscosity Index | 93 | 111 | 115 | 115 | 114 |
| Pour Point, C | −18 | −18 | −16 | −18 | −19 |
| Saturates, wt % | 58.3 | 100 | 85.2 | 91 | 96.2 |
| DMSO Screener for toxicity (2) | 0.30 | 0.02 | 0.06 | 0.10 | 0.04 |
| 370C + Yield, wt % on raffinate feed | 100 | 87 | 81 | 81 | 82 |

* Other Conditions: 1800 psig (12.5 mPa) H2 inlet pressure, 2400 SCF/B (427 m3/m3)
(1) 93 VI under extracted feed
(2) Maximum ultra-violet absorbance at 340 to 350 nm.

TABLE 3

| | SOR | | EOR | |
|---|---|---|---|---|
| Reactor | T (C) | LHSV (v/v/h) | T (C) | LHSV (v/v/h) |
| A | 355 | 0.7 | 394 | 0.7 |
| B | 355 | 1.2 | 394 | 1.2 |
| C | 290 | 2.5 | 290 | 2.5 |

*Other Conditions: 1800 psig (12.5 mPa) H2 inlet pressure, 2400 SCF/B (427 m3/m3)
Dewaxed Oil 100N TABLE 3-continued

| Properties | (1) Feed | SOR | EOR |
|---|---|---|---|
| 100C Viscosity, cSt | 4.35 | 3.91 | 3.83 |
| 40C Viscosity, cSt | 22.86 | 18.23 | 17.36 |
| Viscosity Index | 95 | 108 | 112 |
| Pour Point, C | −18 | −18 | −18 |
| Saturates, wt % | 64.6 | 99 | 93.3 |
| DMSO Screener for toxicity (2) | 0.25 | 0.01 | 0.03 |
| 370 C + Yield, wt % on raffinate feed | 93 | 80 | 75 |

(1) 95 VI under extracted feed
(2) Maximum ultra-violet absorbance at 340 to 350 nm.

EXAMPLE 3

The effect of temperature and pressure on the concentration of saturates (dewaxed oil) at constant VI is shown in this example for processing the under extracted 250N raffinate feed. Dewaxed product saturates equilibrium plots (FIG. 5) were obtained at 600, 1200 and 1800 psig (4.24, 8.38 and 12.5 mPa) H2 pressure. Process conditions were 0.7 LHSV (reactor A+B) and 1200 to 2400 SCF/B (214 to 427 $m^3/m^3$). Both reactors A and B were operating at the same temperature (in the range 350 to 415° C.).

As can be seen from the figure it is not possible to achieve 90 wt. % saturates at 600 psig (4.14 mPa) hydrogen partial pressure. While in theory, one could reduce the temperature to reach the 90 wt. % target, the space velocity would be impracticably low. The minimum pressure to achieve the 90 wt. % at reasonable space velocities is about 1000 psig (7.0 mPa). Increasing the pressure increases the temperature range which may be used in the first two reactors (reactor A and B). A practical upper limit to pressure is set by higher cost metallurgy typically used for hydrocrackers, which the process of the invention can avoid.

EXAMPLE 4

The catalyst deactivation profile as reflected by temperature required to maintain product quality is shown in this example. FIG. 4 is a typical plot of isothermal temperature (for reactor A, no reactor B) required to maintain a VI increase of 18 points versus time on stream. KF840 catalyst was used for reactors A and C. Over a two year period, reactor A temperatures could increase by about 50° C. This will affect the product saturates content. Strategies to offset a decline in product saturates as reactor A temperature is increased are shown below.

EXAMPLE 5

This example demonstrates the effect of temperature staging between the first (reactor A) and second (reactor B) hydroconversion units to achieve the desired saturates content for a 1400 psig (9.75 mPa) $H_2$ process with a 93 VI raffinate feed.

TABLE 4

| | Reactor Sequence: | | | |
|---|---|---|---|---|
| | Base Case | | Temperature Staged Case | |
| Reactor | T (C) | LHSV (v/v/h) | T (C) | LHSV (v/v/h) |
| A | 390 | 0.7 | 390 | 0.7 |
| B | 390 | 1.2 | 350 | 0.5 |
| C | 290 | 2.5 | 290 | 2.5 |
| Dewaxed Oil Viscosity Index | 114 | | 115 | |
| Dewaxed Oil Saturates, wt % | 80 | | 96 | |

A comparison of the base case versus the temperature staged case demonstrates the merit of operating reactor B at lower temperature and space velocities. The bulk saturates content of the product was restored to the thermodynamic equilibrium at the temperature of reactor B.

EXAMPLE 6

Figure 8:
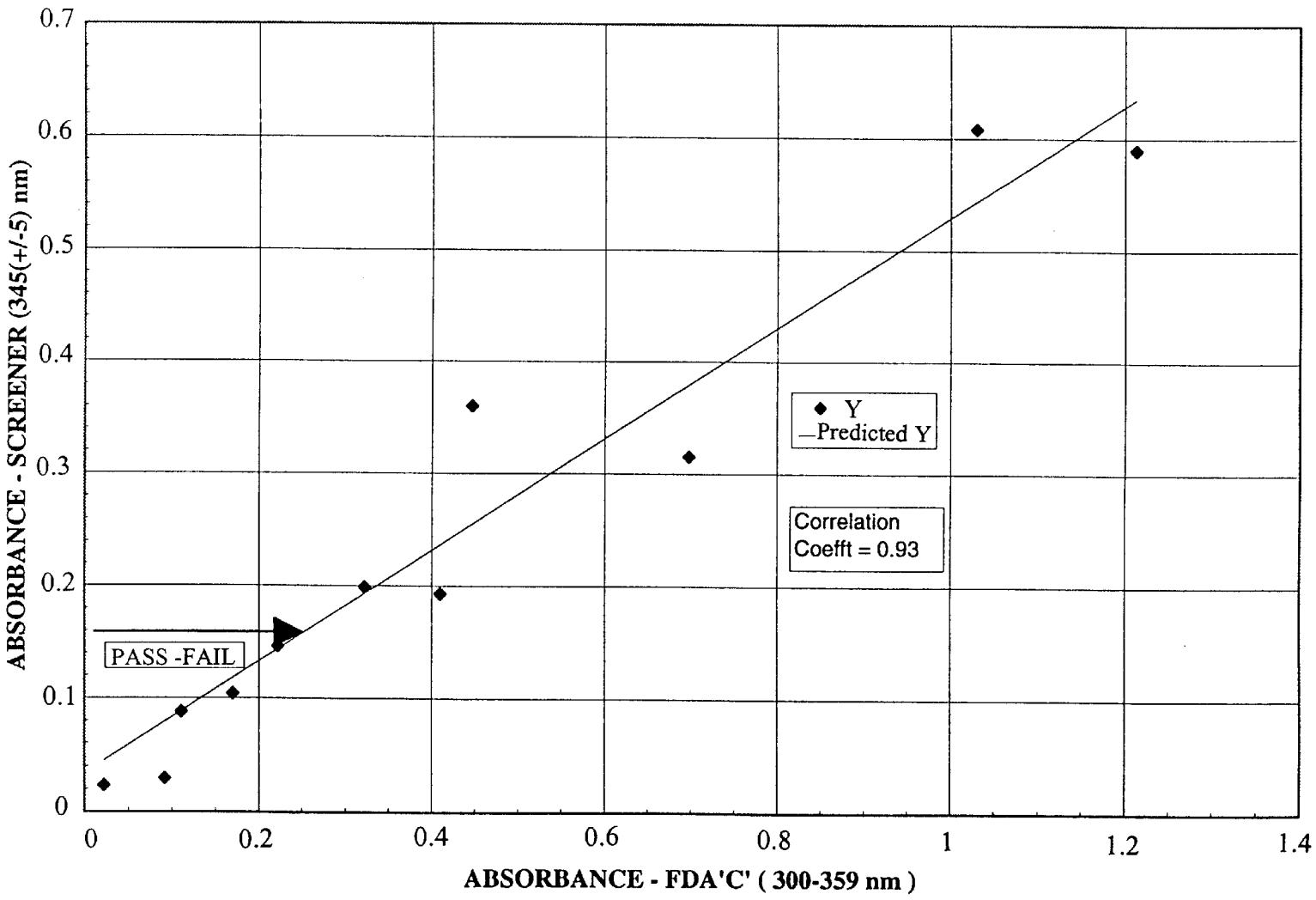
FIG. 8 is a graph showing the correlation between the DMSO screener test and the FDA (c) test.

The effects of temperature and pressure in the cold hydrofinishing unit (reactor C) on toxicity are shown in this example. The toxicity is estimated using a dimethyl sulphoxide (DMSO) based screener test developed as a surrogate for the FDA (c) test. The screener and the FDA (c) test are both based on the ultra-violet spectrum of a DMSO extract. The maximum absorbance at 345+/−5 nm in the screener test was shown to correlate well with the maximum absorbance between 300–359 nm in the FDA (c) test as shown in FIG. 8. The upper limit of acceptable toxicity using the screener test is 0.16 absorbance units. As shown in FIG. 6, operating at 1800 psig (12.7 Mpa) versus 1200 psig (8.38 Mpa) hydrogen partial pressure allows the use of a much broader temperature range (eg., 290 to ~360° C. versus a maximum of only about 315° C. when operating at 1200 psig $H_2$ (8.35 Mpa)) in the cold hydrofinisher to achieve a non-toxic product. The next example demonstrates that higher saturates, non-toxic products can be made when reactor C is operated at higher temperature.

EXAMPLE 7

This example is directed to the use of the cold hydrofinishing (reactor C) unit to optimize saturates content of the oil product. Reactors A and B were operated at 1800 psig (12.7 mPa) hydrogen partial pressure, 2400 Scf/B (427 $m^3/m^3$) treat gas rate, 0.7 and 1.2 LHSV respectively and at a near end-of-run (EOR) temperature of 400° C. on a 92 VI 250N raffinate feed. The effluent from reactors A and B contains just 85% saturates. Table 5 shows the conditions used in reactor C needed to render a product that is both higher saturates content and is non-toxic. At 350° C., reactor C can achieve 90+% saturates even at space velocities of 2.5 v/v/hr. At lower LHSV, saturates in excess of 95% are achieved.

TABLE 5

| | RUNS | | | |
|---|---|---|---|---|
| Run No. | 1 | 2 | 3 | 4 |
| Temperature, ° C. | 290 | 330 | 350 | 350 |
| LHSV, v/v/hr | 2.5 | 2.5 | 2.5 | 1.0 |

TABLE 5-continued

| | RUNS | | | |
|---|---|---|---|---|
| Run No. | 1 | 2 | 3 | 4 |
| H2 Press, psig | 1800 | 1800 | 1800 | 1800 |
| Treat Gas Rate, SCF/B | 2400 | 2400 | 2400 | 2400 |
| DWO VI | 115 | 114 | 115 | 114 |
| DWO Saturates, wt % | 85 | 88 | 91 | 96 |
| DMSO Screener for Toxicity (1) | 0.06 | 0.05 | 0.10 | 0.04 |

(1) Maximum ultra-violet absorbance at 340–350 nm

Figure 7:
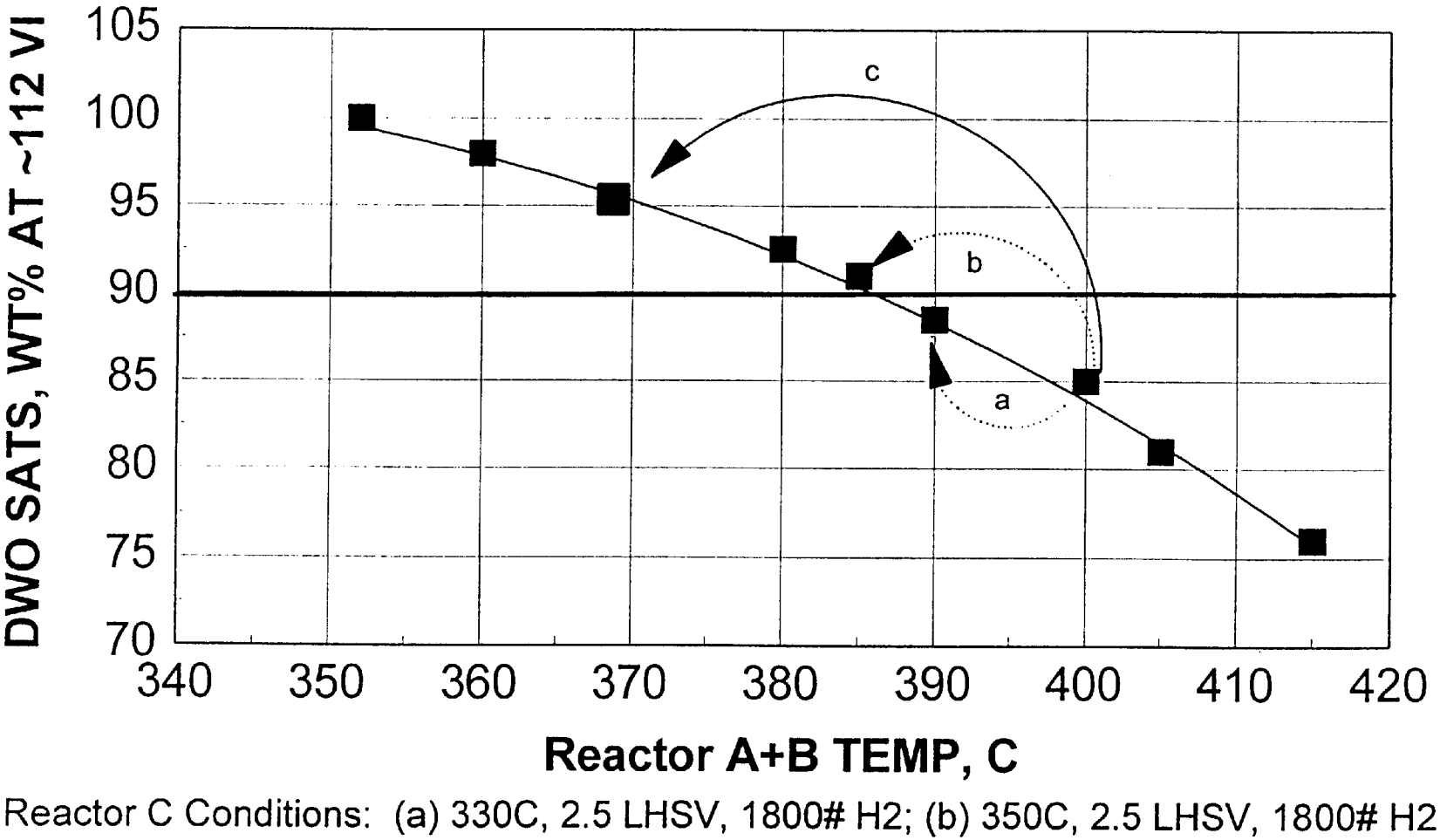
FIG. 7 is a graph showing control of saturates concentration by varying conditions in the cold hydrofinishing step.

FIG. 7 further illustrates the flexible use of reactor C. As shown in FIG. 7, optimization of reactor C by controlling temperature and space velocity gives Group II basestocks

EXAMPLE 8

This example demonstrates that feeds in addition to raffinates and dewaxed oils can be upgraded to higher quality basestocks. The upgrading of low value foots oil streams is shown in this example. Foots oil is a waxy by-product stream from the production of low oil content finished wax. This material can be used either directly or as a feed blendstock with under extracted raffinates or dewaxed oils. In the example below (Table 6), foots oil feeds were upgraded at 650 psig (4.58 mPa) $H_2$ to demonstrate their value in the context of this invention. Reactor C was not included in the processing. Two grades of foots oil, a 500N and 150N, were used as feeds.

TABLE 6

| | 500 N | | 150 N | |
|---|---|---|---|---|
| | Feed | Product | Feed | Product |
| Temperature, ° C. (Reactor A/B) | — | 354 | — | 354 |
| Treat Gas rate, Scf/B, ($m^3/m^3$) | — | 500 (89) | — | 500 (89) |
| Hydrogen partial pressure, psig (mPa) | — | 650 (4.58) | — | 650 (4.58) |
| LHSV, v/v/hr (Reactor A + B) | — | 1.0 | — | 1.0 |
| Wt. % 370° C. - on feed | 0.22 | 3.12 | 1.10 | 2.00 |
| 370° C. + DWO Inspections | | | | |
| 40° C. viscosity, cSt | 71.01 | 48.80 | 25.01 | 17.57 |
| 100° C. viscosity, cSt | 8.85 | 7.27 | 4.77 | 4.01 |
| VI/Pour Point, ° C. | 97/−15 | 109/−17(2) | 111/−8 | 129/−9(2) |
| Saturates, wt. % | 73.4 | 82.8(1) | 79.03 | 88.57(1) |
| GCD NOACK, wt. % | 4.2 | 8.0 | 19.8 | 23.3 |
| Dry Wax, wt. % | 66.7 | 67.9 | 83.6 | 83.3 |
| DWO Yield, wt. % of Foots Oil Feed | 33.2 | 31.1 | 16.2 | 15.9 |

(1)Saturates improvement will be higher at higher hydrogen pressures
(2)Excellent blend stock Table 6 shows that both a desirable basestock with significantly higher VI and saturates content and a valuable wax product can be recovered from foots oil. In general, since wax molecules are neither consumed or formed in this process, inclusion of foots oil streams as feed blends provides a means to recover the valuable wax while improving the quality of the resultant base oil product.

EXAMPLE 9

The route to improved volatility at a fixed viscosity is to selectively increase the VI of the base oil. Molecularly this requires that the base oil become relatively richer in isoparaffinic species. They have the highest boiling points at a given viscosity. Mid boiling point can be increased (i.e., volatility decreased) by increasing the cut point on a particular sample, thereby raising viscosity. To maintain viscosity at a given cut width and increase mid boiling point necessarily means that the basestock have fewer clustered rings, either naphthenic or aromatic, and more paraffinic character. Isoparaffins are preferred because they have much higher boiling points for the same viscosity versus naphthenes and aromatic multi-rings. They also have lower melting points than normal paraffins. Most crudes have an inherently high population of clustered rings that separations-based processing alone cannot selectively remove to achieve the quality required for modern passenger car motor oils (PCMO's) (i.e., VI of 110 to 120+) in an acceptable yield.

Thermal diffusion is a technique that can be used for separating hydrocarbon mixtures into molecular types. Although it has been studied and used for over 100 years, no really satisfactory theoretical explanation for the mechanism of thermal diffusion exists. The technique is described in the following literature:

A. L. Jones and E. C. Milberger, Industrial and Engineering Chemistry, p. 2689, December 1953.

T. A. Warhall and F. W. Melpolder, Industrial and Engineering Chemistry, p. 26, January 1962. and H. A. Harner and M. M. Bellamy, American Laboratory, p. 41, January 1972. and references therein.

The thermal diffusion apparatus used in the current application was a batch unit constructed of two concentric stainless steel tubes with an annular spacing between the inner and outer tubes of 0.012 in. The length of the tubes was approximate 6 ft. The sample to be tested is placed in the annular space between the inner and outer concentric tubes. The inner tube had an approximate outer diameter of 0.5 in. Application of this method requires that the inner and outer tubes be maintained at different temperatures. Generally temperatures of 100 to 200° C. for the outer wall and about 65° C. for the inner wall are suitable for most lubricating oil samples. The temperatures are maintained for periods of 3 to 14 days.

While not wishing to be bound to any particular theory, the thermal diffusion technique utilizes diffusion and natural convention which arises from the temperature gradient established between the inner and outer walls of the concentric tubes. Higher VI molecules diffuse to the hotter wall and rise. Lower VI molecules diffuse to the cooler inner walls and sink. Thus a gradient of different molecular densities is established over a period of days. In order to sample the gradient, sampling ports are approximately equidistantly spaced between the top and bottom of the concentric tubes. Ten is a convenient number of sampling ports.

Two samples of oil basestocks were analyzed by thermal diffusion techniques. The first is a conventional 150N basestock having a 102 VI and prepared by solvent extraction/dewaxing methods. The second is a 112 VI basestock prepared by the raffinate hydroconversion (RHC) process according to the invention from a 100 VI, 250N raffinate. The samples were allowed to sit for 7 days after which samples were removed from sampling ports 1–10 spaced from top to bottom of the thermal diffusion apparatus.

Figure 9:
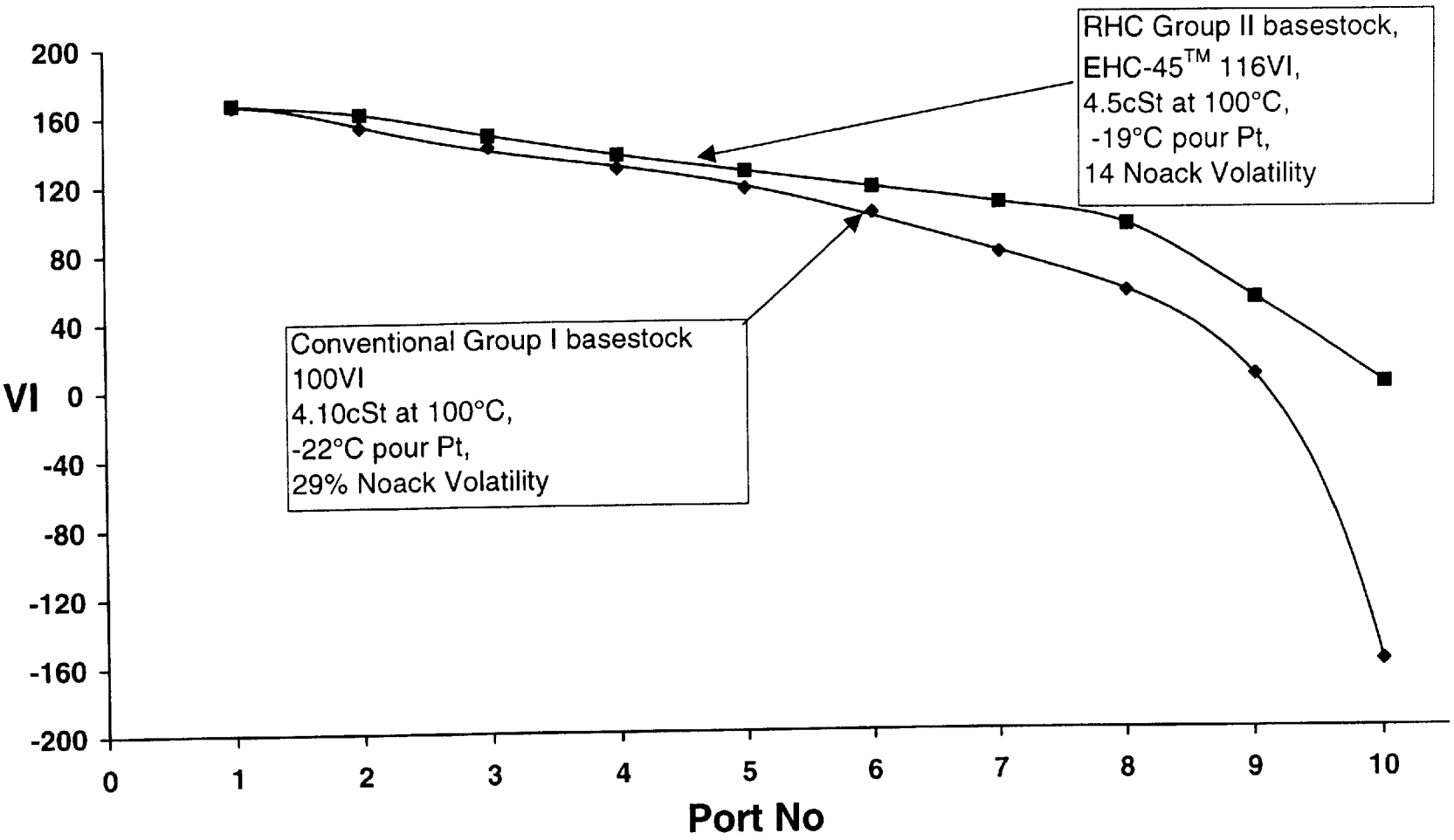
FIG. 9 is a graph showing thermal diffusion separation vs. viscosity index.

The results are shown in FIG. 9. FIG. 9 demonstrates that even a "good" conventional basestock having a 100 VI contains some very undesirable molecules from the standpoint of VI. Thus sampling ports 9 and especially 10 yield molecular fractions containing very low VI's. These fractions which have VI's in the 0 to −160 range likely contain multi-ring naphthenes, and are not captured by the extraction process. In contrast, the RHC product according to the invention contains far fewer multi-ring naphthenes as evidenced by the VI's for products obtained from sampling ports 9 and 10. Thus the present RHC process selectively destroys multi-ring naphthenes and multi-ring aromatics from the feed without affecting the bulk of the other higher quality molecular species. The efficient removal of the undesirable species as typified by port 10 is at least partially responsible for the improvement in NOACK volatility at a given viscosity.

The excellent properties of basestocks according to invention are given in the following table.

TABLE 7

| | A | B |
|---|---|---|
| Viscosity Index | 116 | 114 |
| Viscosity, @ 100° C., cSt | 4.5 | 5.9 |
| Volatility, Noack, wt. % | 14 | 8 |
| Pour Point, ° C. | −18 | −18 |
| Saturates by HPLC, wt. % | 98 | 97 |

EXAMPLE 10

A 250N distillate was extracted with NMP under the conditions set forth in Table 8. Water was added to the NMP solvent at 5 vol. % according to the invention to favor high yield of raffinate and at 0.5 vol. % as a comparative example of typical raffinate under normal extraction conditions.

TABLE 8

Dewaxed (−18° C. Pour) Raffinate Composition: 250N

| Countercurrent Extraction | Example 10 | Comparative Example 10 |
|---|---|---|
| Conditions | | |
| Treat, LV % | 275 | 90 |
| % $H_2O$ in Solvent | 5 | 0.5 |
| Temperature, ° F. (° C.) (Bottom) | 176 (80) | 124 (51) |
| Gradient, F | 11 | 11 |
| Yield, LV % | 66 | 61 |
| Quality | 97 | 97 |
| VI | | |
| | Composition LV % | |
| Saturates | | |
| 0 − R | 24 | 22 |
| 1 − R | 15 | 13 |
| 2 − R | 11 | 11 |
| 3 − R | 9 | 11 |
| 4 − R | 5 | 7 |
| 5 + R | 2 | 2 |
| Total Saturates | 66 | 66 |
| Aromatics | | |
| 1 − R | 18 | 18 |
| 2 − R | 3 | 3 |
| 3 − R | 1 | 1 |
| 4 − R | 0.5 | 0.5 |
| 5 − R | 0.5 | 0.5 |
| Thiopheno | 4 | 4 |
| Total Aromatics | 27 | 27 |
| Unidentified | 7 | 7 |

The data demonstrate that the raffinate according to the invention extracted with NMP containing 5 LV % water provides a superior feed to the first hydroconversion unit. The raffinate feed results in about 5 LV % more yield (at 97 VI) and about 4 LV % more paraffin plus 1-ringnaphthenes and about 4 LV % less 3+ ring naphthenes.

Based on the data in Table 8, RHC feed should be extracted at low severity to target a maximum of 3+ ring compounds (aromatics and naphthenes) rather that to target VI. The highest yield of such raffinate will be obtained using high water/high treat extraction conditions. Optimization of extraction could provide 5 LV % or more of waxy raffinate which can be fed to the hydroconversion process without any process debits.

EXAMPLE 11

Figure 10:
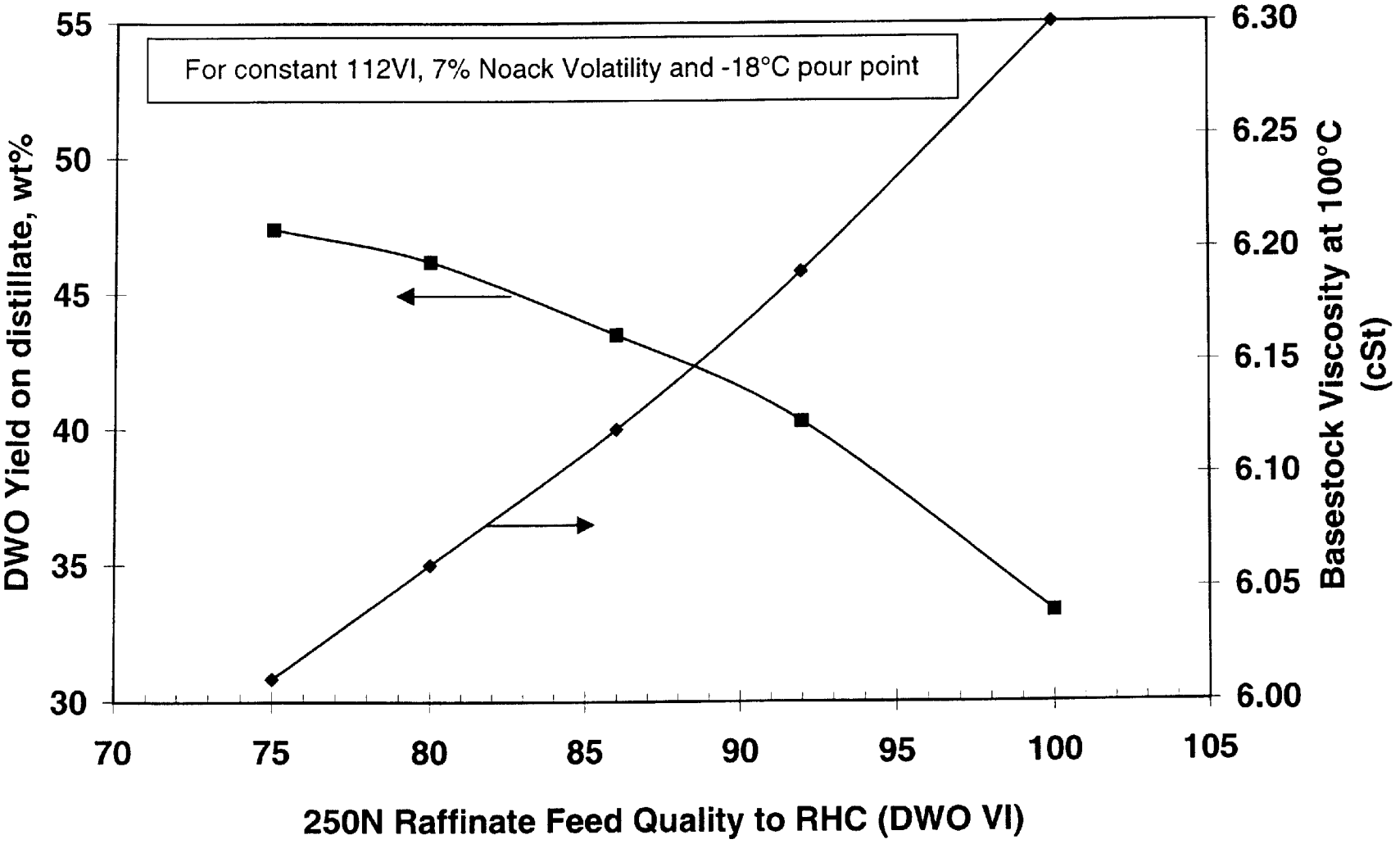
FIG. 10 is a graph showing raffinate feed quality as a function of dewaxed oil yield and basestock viscosity.

A unique feature of the products from the present process is that both yield and the crucial volatility/viscosity properties are improved by using under-extracted feeds. In other processes, yield improvements are generally at the expense of basestock quality. FIG. 10 is a graph illustrating the raffinate feed quality as a function of yield and viscosity. A 250N distillate was extracted, hydroprocessed, vacuum stripped and dewaxed to produce a constant VI (113), 7.0% NOACK volatility basestock with a −18° C. pour point. As shown in FIG. 10, preferred feeds have a DWO VI between about 80 to about 95.

EXAMPLE 12

Figure 11:
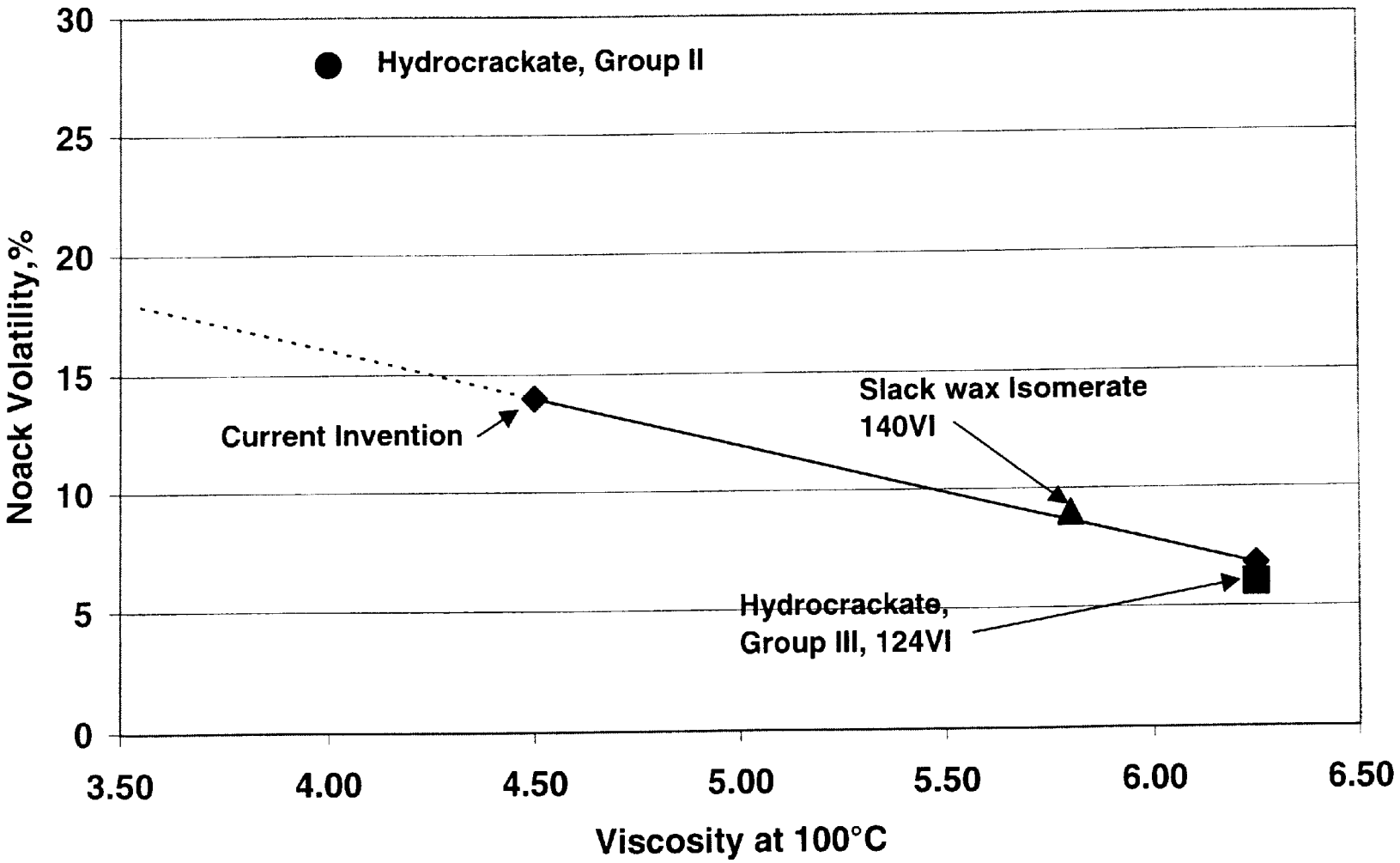
FIG. 11 is a graph showing viscosity vs. Noack volatility for different basestocks.

FIG. 11 illustrates that the Group II products from the current invention most closely follow the volatility-viscosity relationship of Group III basestocks (having much higher VI's). The Figure also compares this behavior with the much poorer volatility-viscosity relationship of a standard Group II hydrocrackate. The basestocks of the invention have unique properties in that they have VI<120 and yet have viscosity/volatility properties comparable to Group III basestocks (>120 VI). Those basestocks characterized as having viscosities in the range 3.5 to 6.0 cSt at 100° C. are defined by the equation N=(32−(4)(viscosity at 100° C.))±1 where N is the Noack volatility.

Figure 12:
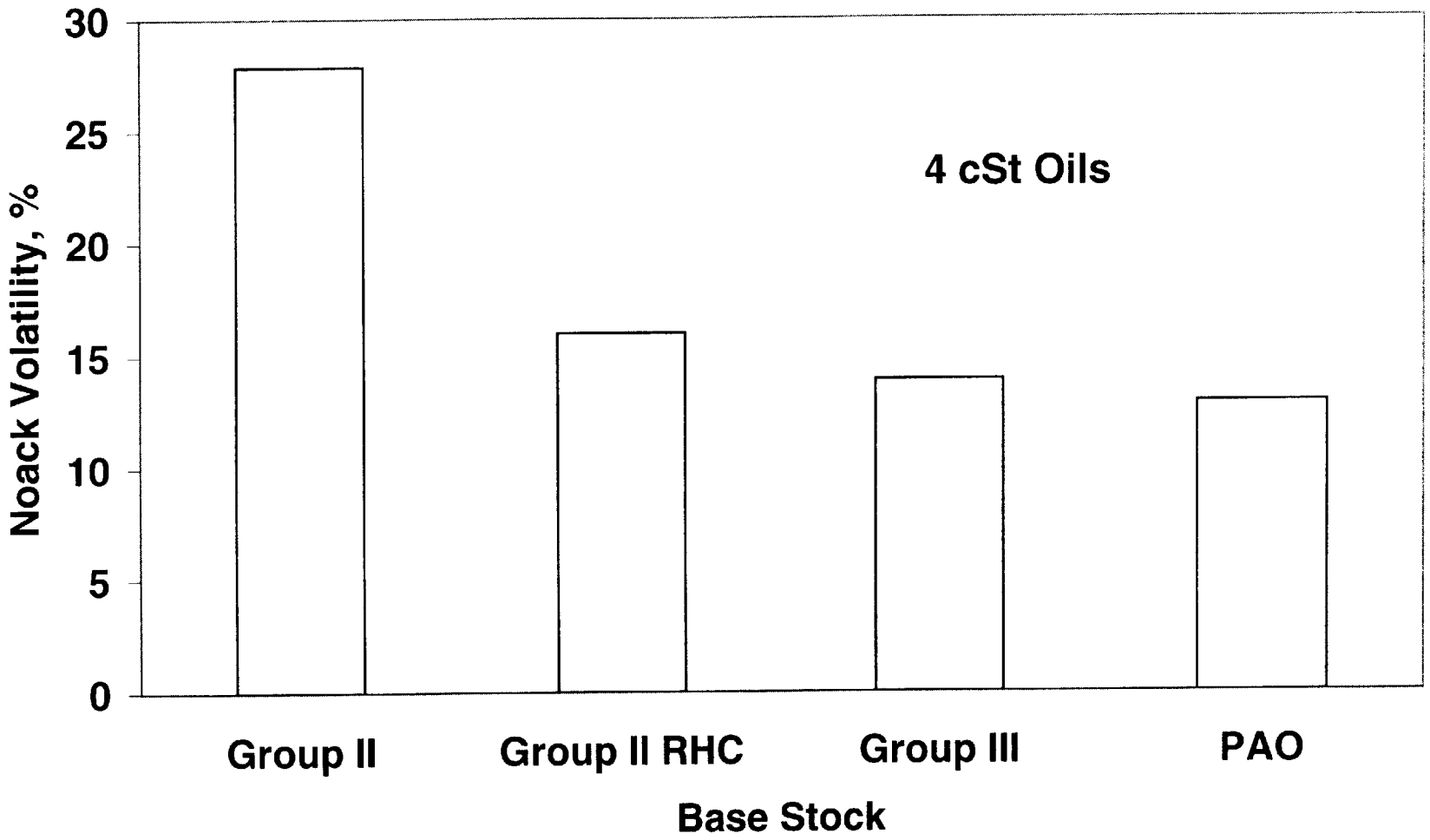
FIG. 12 is a graph showing Noack volatility vs. basestock type.

FIG. 12 shows that the Group II basestock according to the invention has a superior Noack volatility compared to the conventional Group II basestock based on 4 cSt oils.

EXAMPLE 13

It is well known that basestock quality can affect finished oil performance in certain standard industry tests. The performance of the present basestocks in fully formulated GF-2 type 5W-30 formulations was therefore assessed in both bench and sequence engine tests.

An in-house bench oxidation test was first used to assess the resistance to oxidative thickening offered by the present basestocks compared to conventionally processed Group I stocks. The test oil is subjected to air sparging in the presence of a soluble iron catalyst at 165° C.; the change in 40° C. kinematic viscosity with time is recorded and an estimate of the hours to reach 375% viscosity increase is made. Two different additive systems were compared in the conventional Group I and in the present basestocks (designated as "EHC") in Table 9 below:

TABLE 9

| Blend Number | 1 | 2 | 3 | 4 |
|---|---|---|---|---|
| Performance Additive System | A | B | A | B |
| Basestocks | Group I | Group I | EHC | EHC |
| Oxidation Screener, est. hrs to 375% vis. increase | 57.5 | 82.5 | 72.0 | 83.5 |

Additive systems A and B are conventional additive packages. Additive system A includes a detergent, dispersant, antioxidant, friction modifier, demulsifier, VI improver and antifoamant. Additive system B includes a detergent, dispersant, antioxidant, friction modifier, antifoamant and VI improver. The individual components within each additive package may vary according to the manufacturer. The basestocks according to the invention were found to provide significant improvement in oxidation performance over the conventional basestock with additive system 'A', and somewhat smaller improvement with additive system 'B'.

The oxidation screener can only provide a general indication of oxidation resistance. To confirm engine performance, Sequence IIIE tests were conducted on the Group I and on the EHC stocks in 5W-30 formulations using additive system 'B'. The Sequence IIIE test is a standard industry bench engine test which assesses oxidation resistance, wear and high temperature deposits (ASTM D 5533). The results, shown in Table 10, indicated that the EHC basestocks provided improved oxidation control (beyond that predicted in the bench screener), as well as good control of high temperature deposits.

TABLE 10

| Blend Number | 5 | 6 | |
|---|---|---|---|
| Performance Additive System | B | B | |
| Basestocks | Group I | EHC | |
| Seq. IIIE | | | Limits |
| % Viscosity Increase @ 64 hr | 182 | 63 | 375 max |
| Hours to 375% Vis. Increase | 71.2 | 78.9 | 64 min |
| Avg. Engine Sludge, merits | 9.57 | 9.51 | 9.2 min |
| Avg. Piston Skirt Varnish, merits | 9.31 | 9.17 | 8.9 min |
| Oil Ring Land Deposits, merits | 3.02 | 3.96 | 3.5 min |
| Stuck Lifters | none | none | none |
| Scuffed/Worn Cam or Lifters | none | none | none |
| Avg. Cam + Lifter Wear, microns | 15.4 | 9 | 30 |
| Max. Cam + Lifter Wear, microns | 74 | 20 | 64 |
| Oil Consumption, L | 3.85 | 2.55 | Report |

Figure 13:
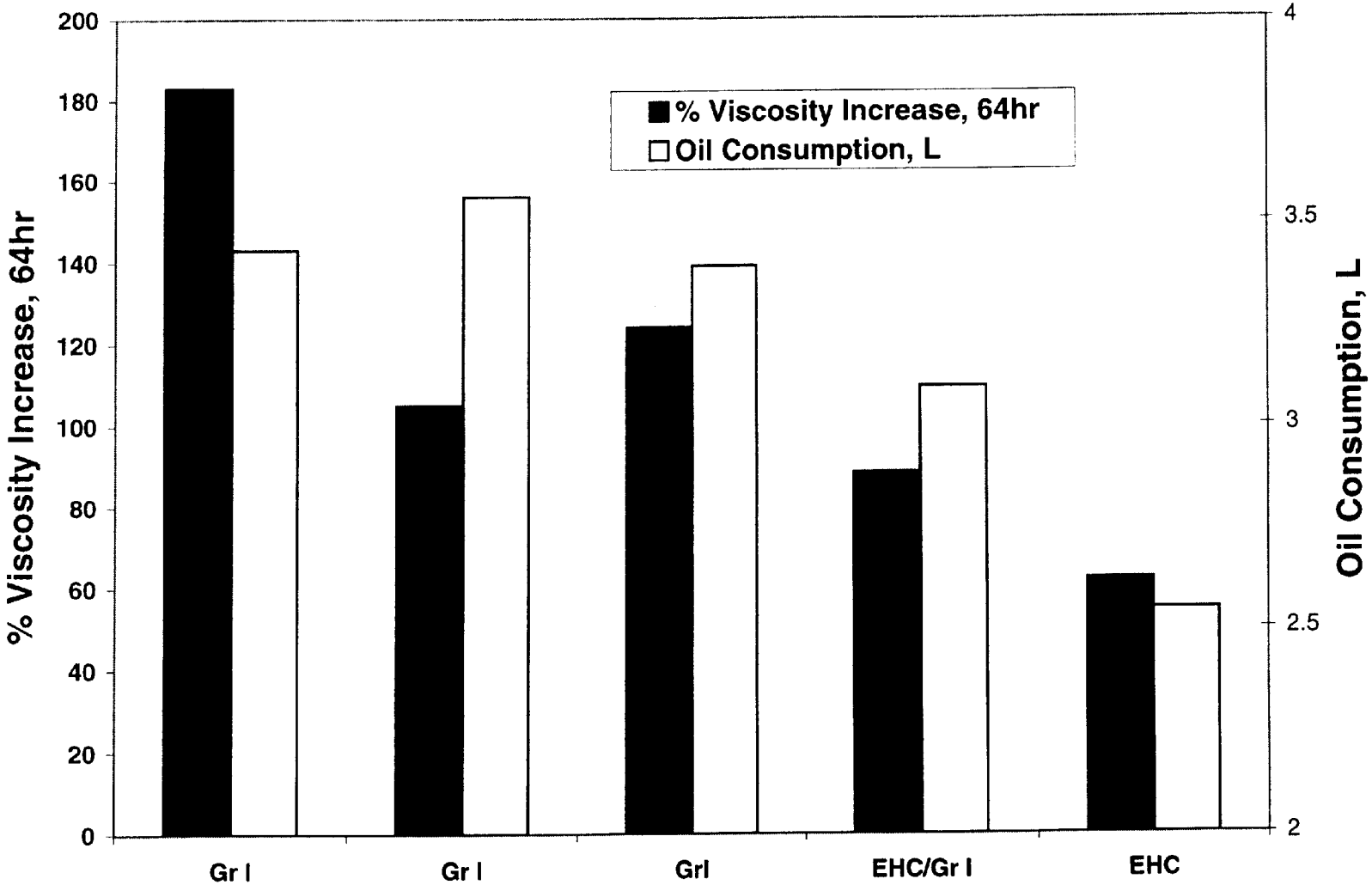
FIG. 13 is a graph showing percent viscosity increase and oil consumption as a function of basestock type.

Repeat IIIE testing on the Group I, 5W-30, showed that this additive system could meet the wear and ring land deposit requirements in conventionally refined stocks. However, viscosity increase remained better for the EHC formulations, either alone, or in combination with Group I basestocks as shown in FIG. 13. Oil consumption was also consistently lower for the EHC formulation, probably due to the lower volatility of these basestocks.

EXAMPLE 14

The Sequence VE is another key engine test which measures sludge, varnish and wear under relatively low engine operating temperatures. Comparative tests were conducted on SAE 5W-30 formulations made with Group I and with EHC stocks in another additive system. These indicated that the EHC basestocks provided at least as good control of sludge and better average varnish than the conventional stock (Table 11).

TABLE 11

| Blend Number | 7 | 8 | |
|---|---|---|---|
| Performance Additive System | C | C | |
| Basestocks | Group I | EHC | |
| Seq. VE | | | Limits |
| Avg. Engine Sludge, merits | 9.14 | 9.49 | 9.0 min |
| Rocker Cover Sludge, merits | 8.28 | 9.04 | 7.0 min |
| Piston Skirt Varnish, merits | 7.02 | 6.90 | 6.5 min |
| Avg. Engine Varnish, merits | 5.43 | 6.25 | 5.0 min |
| Oil Screen Clogging, % | 3 | 0 | 20 max |
| Hot Stuck Rings | none | none | none |
| Avg. Cam Wear, microns | 83.6 | 18 | 130 max |
| Max. Cam Wear, microns | 231 | 27 | 380 max |

EXAMPLE 15

Lubricant fuel economy and fuel economy retention has become of increasing importance to original equipment manufacturers, and this is reflected in the greater demands of standard industry tests. Proposed Sequence VIB fuel economy limits from the draft ILSAC GF-3 specification are shown in Table 12 along with single test results on SAE 5W-20, 5W-30 and 10W-30 prototype formulations containing EHC basestocks and a single additive system. It is apparent that the EHC stocks offer the potential to meet these very demanding limits.

TABLE 12

| Performance Additive System | D | |
|---|---|---|
| Basestocks | EHC | |
| | | Originally Proposed Limits |
| 5W-20 | | |
| 16 hr, % Fuel Economy Improvement | 2.0 | 2.0 min |
| 96 hr, % Fuel Economy Improvement | 1.8 | 1.7 min |
| 5W-30 | | |
| 16 hr, % Fuel Economy Improvement | 1.7 | 1.7 min |
| 96 hr, % Fuel Economy Improvement | 1.4 | 1.4 min |
| 10W-30 | | |
| 16 hr, % Fuel Economy Improvement | 1.4* | 1.3 min |
| 96 hr, % Fuel Economy Improvement | 1.1* | 1.0 min |

*Referenced engine stand, latest Sequence VIB industry Severity Bias Correction Factors applied

What is claimed is:

1. A lubricating oil basestock produced by a process which comprises:

(a) conducting a lubricating oil feedstock, said feedstock being a distillate fraction, to a solvent extraction zone and under-extracting the feedstock to form an under-extracted raffinate;

(b) stripping the under-extracted raffinate of solvent to produce an under-extracted raffinate feed having a dewaxed oil viscosity index from about 85 to about 105 and a final boiling point of no greater than about 650° C.;

(c) passing at least a portion of the raffinate feed to a first hydroconversion zone and processing the raffinate feed in the presence of a non-acidic catalyst at a temperature of from 340 to 420° C., a hydrogen partial pressure of from 1000 to 2500 psig (7.0 to 17.3 mPa), space velocity of 0.2 to 3.0 LHSV and a hydrogen to feed ratio of from 500 to 5000 Scf/B (89 to 890 $m^3/m^3$) to produce a first hydroconverted raffinate;

(d) passing the hydroconverted raffinate from the first hydroconversion zone to a second hydroconversion zone and processing the hydroconverted raffinate in the presence of a non-acidic catalyst at a temperature of from 340 to 420° C. provided that the temperature in the second hydroconversion is not greater than the temperature in the first hydroconversion zone, a hydrogen partial pressure of from 1000 to 2500 psig (7.0 to 17.3 mPa), a space velocity of from 0.2 to 3.0 LHSV and a hydrogen to feed ratio of from 500 to 5000 Scf/B (89 to 890 $m^3/m^3$) to produce a second hydroconverted raffinate;

(e) passing at least a portion of the second hydroconverted raffinate to a hydrofinishing reaction zone and conducting cold hydrofinishing of the second hydroconverted raffinate in the presence of a hydrofinishing catalyst at a temperature of from 260 to 360° C., a hydrogen partial pressure of from 1000 to 2500 psig (7.0 to 17.3 mPa), a space velocity of from 0.2 to 5 LHSV and hydrogen to feed ratio of from 500 to 5000 Scf/B (89 to 890 $m^3/m^3$) to produce a hydrofinished raffinate.

2. The basestock of claim 1 wherein the solvent extraction zone includes an extraction solvent selected from at least one of N-methyl-2-pyrrolidone, furfural and phenol.

3. The basestock of claim 1 wherein the non-acidic catalyst has an acidity less than about 0.5, said acidity being determined by the ability of the catalyst to convert 2-methyl-2-pentene to 3-methyl-2-pentene and 4-methyl-2-pentene and is expressed as the mole ratio of 3-methyl-2-pentene to 4-methyl-2-pentene.

4. The basestock of claim 1 wherein the non-acidic catalyst in the first hydroconversion zone is at least one of a Group VIB metal and non-noble Group VIII metal.

5. The basestock of claim 4 wherein the non-acidic catalyst is cobalt/molybdenum, nickel/molybdenum or nickel/tungsten on alumina.

6. The basestock of claim 1 wherein the temperature in the hydrofinishing zone is from about 290 to 350° C.

7. The basestock of claim 1 wherein the second hydroconverted raffinate is passed to a separator to separate low boiling products from hydroconverted raffinate prior to passing to the hydrofinishing reaction zone.

8. The basestock of claim 1 wherein the hydrofinished raffinate is passed to a separator to separate low boiling products from the hydrofinished raffinate to produce a second hydrofinished raffinate.

9. The basestock of claim 8 wherein the second hydrofinished raffinate is passed to a dewaxing zone and subjected to at least one of solvent dewaxing and catalytic dewaxing to produce a dewaxed second hydrofinished raffinate.

10. The basestock of claim 9 wherein the catalytic dewaxing is accomplished with a dewaxing catalyst containing at least one 10 ring molecular sieve.

11. The basestock of claim 1 additionally comprising additives.

* * * * *